US006544012B1

(12) United States Patent
Blume

(10) Patent No.: US 6,544,012 B1
(45) **Date of Patent: *Apr. 8, 2003**

(54) HIGH PRESSURE PLUNGER PUMP HOUSING AND PACKING

(76) Inventor: George H. Blume, 107 Morning Cloud Cove, Austin, TX (US) 78734

( * ) Notice: Subject to any disclaimer, the term of this patent is extended or adjusted under 35 U.S.C. 154(b) by 0 days.

This patent is subject to a terminal disclaimer.

(21) Appl. No.: 10/139,770

(22) Filed: May 6, 2002

Related U.S. Application Data

(63) Continuation-in-part of application No. 09/618,693, filed on Jul. 18, 2000, now Pat. No. 6,382,940.

(51) Int. Cl.[7] ..... F04B 39/10; F04B 53/10

(52) U.S. Cl. ..... 417/559; 417/454; 417/568; 277/370; 277/437

(58) Field of Search ..... 417/454, 540, 417/559, 567, 568, 509, 571; 277/342, 367, 370, 435, 437, 439, 520, 529; 92/169, 171.1

(56) References Cited

U.S. PATENT DOCUMENTS

| | | | | | |
|---|---|---|---|---|---|
| 2,236,370 | A | * | 3/1941 | Jackman | 286/30 |
| 3,905,608 | A | * | 9/1975 | Olsen et al. | 277/188 |
| 4,467,703 | A | * | 8/1984 | Redwine et al. | 92/128 |
| 4,773,833 | A | * | 9/1988 | Wilkinson et al. | 417/539 |
| 4,878,815 | A | * | 11/1989 | Stachowiak | 417/63 |
| 5,020,809 | A | * | 6/1991 | Mullaney | 277/81 |
| 6,241,492 | B1 | * | 6/2001 | Pacht | 417/567 |
| 6,267,383 | B1 | * | 7/2001 | Morvant | 277/439 |

* cited by examiner

*Primary Examiner*—Charles G. Freay
*Assistant Examiner*—Han L. Liu
(74) *Attorney, Agent, or Firm*—Dennis W. Gilstad

(57) ABSTRACT

A Y-block fluid section plunger pump housing has a cylinder bore which is transversely elongated at its intersection with suction and discharge bores to provide stress relief and a reduction in housing weight. A spoked ring valve spring retainer ring further reduces stress near the bore intersection and allows use of a top stem guided suction valve. Tapered cartridge packing assemblies facilitate use of a one-piece plunger in Y-block housings and also allow packing in such housings to be changed without removing the plunger.

26 Claims, 24 Drawing Sheets

113
119
115
Section B-B 113
119
115
Section B'-B'

125
Section A-A 76
103
116
114
121
50
126
124
118
125
109
122
113
112
B
B'
A
A
110
115

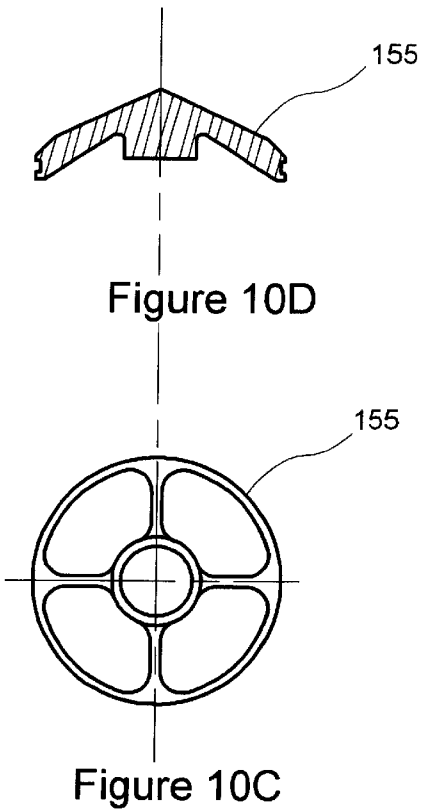
Figure 10D
Figure 10C
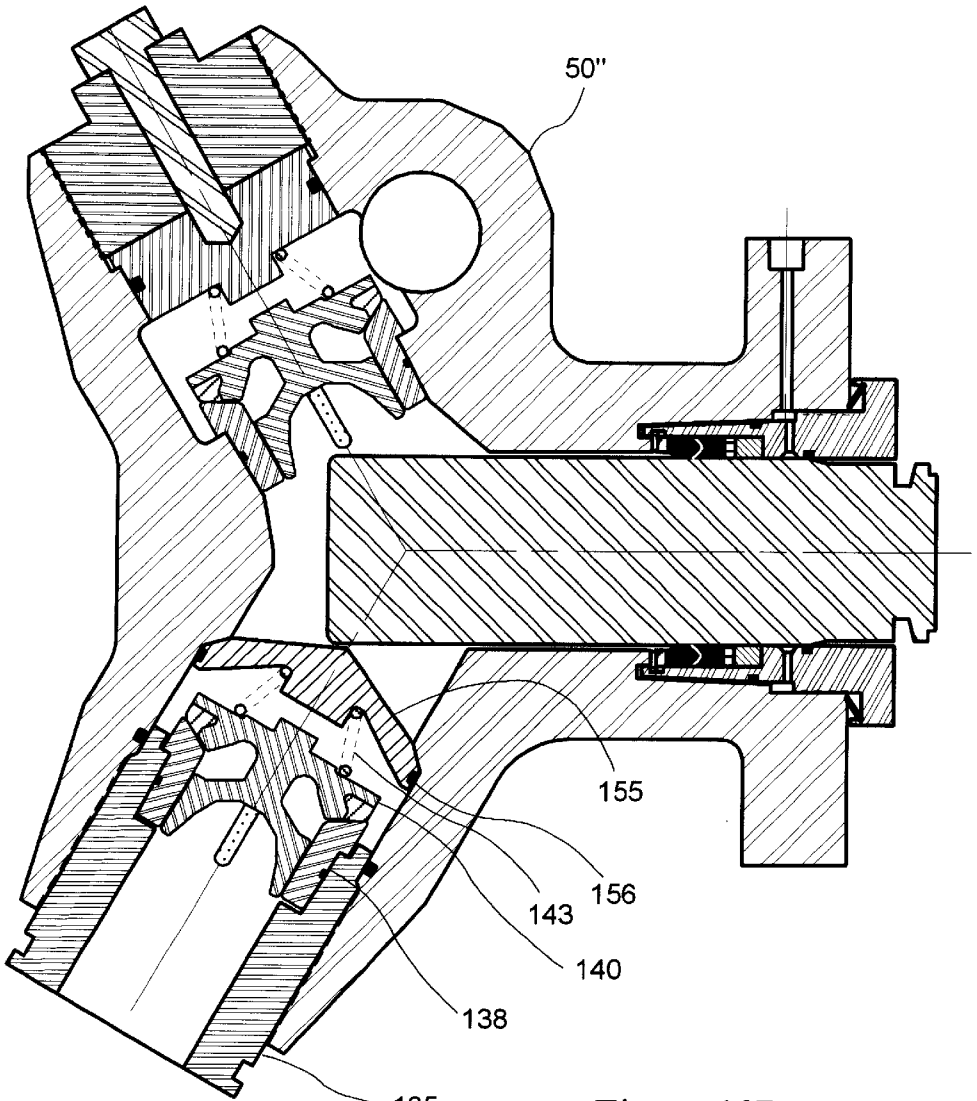
Figure 10B

Section F-F

HIGH PRESSURE PLUNGER PUMP HOUSING AND PACKING

This is a continuation-in-part (CIP) patent application of U.S. Ser. No.: 09/618,693, filed Jul. 18, 2000. U.S. Pat. No. 6,382,940.

FIELD OF THE INVENTION

The invention relates generally to high-pressure plunger pumps used, for example, in oil field operations. More particularly, the invention relates to plunger packing and stress reduction in plunger pump housings.

BACKGROUND

Plunger Pump Stress Failure

Engineers typically design high-pressure oil field plunger pumps in two sections; the (proximal) power section and the (distal) fluid section. The power section usually comprises a crankshaft, reduction gears, bearings, connecting rods, crossheads, crosshead extension rods, etc. The fluid section usually comprises a housing which in turn comprises suction, discharge and cylinder bores, plus plungers, packing, valves, seats, high-pressure seals, etc. FIG. 1 is a cross-sectional schematic view of a typical fluid section showing its connection to a power section by stay rods. A plurality of fluid sections similar to that illustrated in FIG. 1 may be combined, as suggested in the Triplex fluid section design schematically illustrated in FIG. 2.

Each individual bore in a fluid section housing is subject to fatigue due to alternating high and low pressures which occur with each stroke of the plunger cycle. Fluid section housings typically fail due to fatigue cracks in one of the four areas defined by the intersecting suction, plunger and discharge bores as schematically illustrated in FIG. 3.

Among the designs proposed in the past for reducing pump housing fatigue failures in high-pressure fluid sections has been the Y-block housing design. The Y-block design, which is schematically illustrated in FIG. 4, reduces stress concentration in a fluid section housing by increasing the angles of bore intersections above 90°. In the illustrated example of FIG. 4, the bore intersection angles are approximately 120°. A more complete cross-sectional view of a Y-block plunger pump fluid section is schematically illustrated in FIG. 5.

Although several variations of the Y-block design have been evaluated, none have become commercially successftul for several reasons. One such reason is that mechanics find field maintenance on Y-block fluid sections difficult. For example, replacement of plungers and/or plunger packing is significantly more complicated in Y-block designs than in the earlier designs represented in FIG. 1. In the earlier designs, provision is made to push the plunger distally in the cylinder bore, continuing out through an access port labeled the suction valve/plunger cover in the illustration. This operation, which would leave the plunger packing easily accessible from the proximal end of the cylinder bore, is impossible in a Y-block design.

The Y-block configuration, while reducing stress in a fluid section housing, makes it necessary to remove the plunger from the proximal end of the cylinder bore. But because the proximal end of the cylinder bore is very close to the power section, plungers must be removed in two pieces. And even a two-piece plunger, schematically illustrated in FIG. 5, is itself a maintenance problem. The plunger pieces are often heavy and slippery, the connection between plunger pieces is subject to premature failures, and plunger pieces must be connected and disconnected in a confined space with limited visibility and accessibility. Nevertheless, the plunger pieces must be removed entirely from the cylinder bore in order to change conventional plunger packing.

Plunger Packing

A brief review of plunger packing design will illustrate some of the problems associated with packing and plunger maintenance in Y-block fluid sections. FIG. 6 is an enlarged view of the packing in an earlier (but still currently used) fluid section such as that illustrated in FIG. 1. In FIG. 6, the packing and packing brass are installed in the packing box of the fluid section. Note that packing brass is a term used by field mechanics to describe bearing bronze, where the bronze has the appearance of brass.

In the fluid section portion schematically illustrated in FIG. 6, the packing box is an integral part of the fluid section housing; it may also be a separate unit bolted to the fluid section housing. The packing is retained, tightened and adjusted by turning the gland nut. Removing the gland nut, however, does not allow one to remove the packing rings. Because packing rings must block high-pressure fluid leakage past the plunger, they are typically quite stiff, and they remain substantially inaccessible while the plunger (or any piece of it) remains in the cylinder bore. FIG. 7 schematically illustrates portions of a plunger pump housing and components including a gland nut and plunger parts, with the plunger pressure end within the packing box. Note, however, that the plunger pressure end cannot be rotated for removal until it clears the packing brass. This illustrates the necessity for a two-piece plunger in which the two pieces must be separated as they are individually removed from the cylinder bore.

The necessity for a multi-piece plunger in Y-block fluid section housings has not been eliminated by the recent introduction of packing assemblies such as those called "cartridge packing" by UTEX Industries in Houston, Tex. An example of such cartridge packing is schematically illustrated in FIG. 8. Note that removal of the gland nut exposes the packing cartridge housing, which in turn may be fitted with attachment means to allow extraction of the packing cartridge from the packing box (requiring proximal travel of the packing cartridge housing of approximately three to five inches).

This extraction, though, is not practical while a plunger piece lies within the packing box because of the excessive drag of the compressed packing rings on the plunger and packing box walls. Such compression can not be released unless all plunger pieces are removed from the packing box because the packing rings in the above cartridge packing assemblies are pre-compressed when the assemblies are manufactured. Further, any slight misalignment of apparatus used to extract such a cartridge packing assembly tends to cause binding of the (right cylindrical, i.e., not tapered) assembly within the (right cylindrical) bore. Analogous difficulties occur if an attempt is made to replace such a cartridge packing assembly while a plunger or part thereof lies in the packing box area. Hence, even if such cartridge packing assemblies were used in Y-block fluid section housings, multi-piece plungers would preferably be used and field maintenance would be significantly complicated and expensive.

SUMMARY

The invention comprises methods and apparatus to reduce or eliminate the above described problems of premature fluid section pump housing fatigue failure and difficult field maintenance related to plungers and/or plunger packing. In a preferred embodiment of the invention, a Y-block plunger pump housing comprises a suction valve bore having a substantially circular cross-section and a first centerline. Bore centerlines are used herein to assist the reader in understanding how each bore in the fluid section pump housing is spatially related to other bores in the pump housing and other fluid section components.

A discharge valve bore intersects said suction valve bore, said discharge valve bore having a substantially circular cross-section and a second centerline, said first centerline preferably being coplanar with and intersecting said second centerline at a reference point, and said first and second centerlines subtending a first obtuse angle.

A cylinder bore intersects said suction valve bore and said discharge valve bore, said cylinder bore having a proximal packing area (relatively nearer the power section) and a distal transition area (relatively more distant from the power section). The packing area has a substantially circular cross-section and a third centerline. The third centerline is coplanar with said first and second centerlines and intersects them at or near said reference point to allow substantially unimpeded fluid flow from said suction bore to said discharge bore under the influence of reciprocating plunger movement in said cylinder bore. Said second and third centerlines subtend a second obtuse angle, and said first and third centerlines subtend a third obtuse angle. Preferred values for the first, second and third obtuse angles, as well as preferred intersections of the first, second and third bore centerlines, are determined primarily by design guidelines which minimize materials and machining costs. Such guidelines are well known to those skilled in the art.

The transition area of the cylinder bore has a distal elongated cross-section substantially perpendicular to said third centerline and with a long axis substantially perpendicular to the plane of said first, second, and third centerlines. Modern computer-aided finite element stress analysis (FEA) was used to study stress concentrations in the fluid section pump housing design of the present invention and to document the advantages of the above elongated cross-section. Past Y-block pump housing designs, on the other hand, experienced premature fatigue-induced cracks due to stress concentrations that could not be predicted without computers and modem FEA software.

Note that FEA reveals that elongation of the distal portion of the cylinder bore transition area as described above is generally beneficial in reducing stress near the intersections of the cylinder bore transition area with the suction and discharge bores. The shape of the elongation, however, may be optimized to obtain the greatest stress reduction. For example, while an elliptical cross-section is beneficial, an oblong cross-section is more beneficial.

The cross-section of an oblong bore consists of two opposing half-circles connected by substantially straight lines, which leaves a substantially flat area between the cylindrical sections of the oblong bore. These substantially straight lines preferably have length between 5% and 95% of the length of radii of the opposing half circles. The unexpected result of incorporating such an oblong bore is that stresses in all areas of the intersecting bores of the present invention are significantly reduced. Note that stresses are reduced in spite of the fact that pump housing material is removed and the fluid section side wall thickness is reduced in the area of the oblong bore, which would ordinarily be expected to increase stress concentrations rather than reduce them.

An explanation of this surprising phenomenon lies in the intersection of the suction and discharge bores with the flat area of the oblong bore, which (FEA analysis shows) disperses stresses along the flat area. Note that the presence of the flat area effectively increases any discrete angles of intersection between the suction and discharge bores and the cylinder bore. Indeed, by tapering the oblong cylinder bore to flare out from proximal to distal, the transition from either the suction or discharge bore to the right cylindrical portion of the cylinder bore can be made nearly smooth. In contrast, earlier (circular) cylinder bores tend to concentrate stresses where they intersect with circular suction and discharge bores, discrete angles of intersection being relatively smaller than in the present invention.

Another preferred embodiment of the present invention relates to a tapered cartridge packing assembly comprising a packing cartridge housing and related components. The packing cartridge housing has a distal end, a proximal end, a longitudinal axis, and a length between said distal and proximal ends. A substantially right cylindrical inner surface of the cartridge housing has a first diameter and, in certain preferred embodiments, a substantially coaxial right cylindrical outer surface extends distally from said proximal end for a portion of said cartridge housing length. In the latter preferred embodiments, a conically tapered substantially coaxial outer surface extends distally from said distal extent of said right cylindrical outer surface to said cartridge housing distal end, said tapered outer surface tapering distally from said right cylindrical outer surface toward said longitudinal axis.

The right cylindrical outer surface portion, when present, provides for consistent compression (i.e., adequate sealing) of O-ring seals associated with the cylindrical surface during longitudinal movement of a tapered cartridge packing assembly. The O-ring seals may be present in circumferential grooves on the outer cylindrical surface of such an assembly and/or in circumferential grooves on the corresponding inner cylindrical surface of a pump housing made to allow installation of the assembly. Such cylindrical surface portions are preferred for cartridge packing assemblies having conically tapered portions with tapers greater than about 1 degree. For conically tapered portions with tapers between about 0.5 and 1 degree, sealing via O-rings that may lie in one or more grooves on the tapered portion of a cartridge packing assembly (and/or that may lie in one or more grooves in the corresponding tapered surface of a pump housing) becomes less problematical. In such assemblies, the right cylindrical outer surface portion may be made relatively shorter or may be eliminated entirely because adequate O-ring compression for sealing between a cartridge packing assembly and a pump housing is maintained within a range of longitudinal assembly movement necessary for adjusting compression of the packing rings in these assemblies to obtain a sliding seal over a pump plunger.

The inner surface of the packing cartridge housing has a substantially coaxial cylindrical recess having a second diameter greater than said first diameter and extending from said distal end proximally to an internal stop. In certain preferred embodiments, the cylindrical recess has a substantially coaxial internal snap ring groove, said groove having a substantially uniform width and a third diameter greater than said second diameter.

There is at least one circumferential seal groove in said right cylindrical outer surface or, alternatively, in the inner surface of the portion of the pump housing into which a packing cartridge housing is inserted. An elastomeric seal is fitted within each said circumferential seal groove. A substantially coaxial bearing ring lies within the cylindrical recess; it has an inner diameter slightly less than said first diameter and an outer diameter about equal to said second diameter. The bearing ring contacts said internal stop. A substantially coaxial anti-extrusion ring also lies within the cylindrical recess. The anti-extrusion ring contacts said bearing ring. With an inner diameter slightly less than said first diameter and an outer diameter about equal to said second diameter, the anti-extrusion ring has a close sliding fit against a plunger in the cylinder bore, thereby effectively preventing extrusion of plunger packing proximally.

In certain preferred embodiments, a substantially coaxial snap ring having a thickness less than said snap ring groove width lies within the snap ring groove. The snap ring has an inner diameter slightly greater than said first diameter and an outer diameter slightly less than said third diameter, said snap ring having a longitudinal sliding fit within said snap ring groove. The snap ring, when present, aids in removal of certain components of a tapered cartridge packing assembly. But in embodiments having a gland nut integral with the proximal end of the packing cartridge housing, the snap ring may be eliminated.

A substantially coaxial packing compression ring has an inner diameter slightly greater than said first diameter and an outer diameter slightly less than said second diameter. When a snap ring is present, the packing compression ring has a thickness preferably greater than said snap ring groove width reduced by the snap ring thickness. The packing compression ring is positioned between said snap ring and said anti-extrusion ring and contacts said snap ring but is too thick to become lodged in said snap ring groove when the snap ring is in place in the groove. When a snap ring is not present, the packing compression ring is simply positioned distal to the anti-extrusion ring within the packing cartridge housing.

A substantially coaxial packing ring lies within said cylindrical recess. The packing ring has an inner diameter substantially equal to said first diameter and an outer diameter substantially equal to said second diameter. When a snap ring is present, the packing ring has sufficient length to substantially fill said recess between said anti-extrusion ring and said packing compression ring when said snap ring is positioned maximally distally within said snap ring groove. Note that proximally directed longitudinal sliding movement of said snap ring within said snap ring groove causes proximally directed longitudinal sliding movement of said packing compression ring with resultant compression of said packing. When, on the other hand, a snap ring is not present, the packing compression ring may still be caused to slide proximally, compressing the packing as described below.

A tapered cartridge packing assembly of the present invention is advanced distally into the tapered recess of the packing area of a cylinder bore of a plunger pump housing of the present invention through distal motion imparted by turning a threaded gland nut. The gland nut may be separable from the tapered cartridge packing assembly, but in an alternative preferred embodiment referred to above, the gland nut is integral with the proximal end of the packing cartridge housing (a tapered cartridge packing and gland nut assembly).

Before being advanced distally, the coaxial packing ring is uncompressed, which means that drag on a plunger which may be within the packing area of the cylinder bore is relatively low. But when a packing assembly comprising a snap ring is nearly fully inserted into the packing area (that is, within a distance from the end of its travel equal to the snap ring groove width), the snap ring encounters a coaxial cylindrical boss of the pump housing, the proximal face of which is termed the adjusting ring. Further (distal) advance of the packing assembly after the snap ring contacts the adjusting ring results in relative proximal longitudinal movement of the snap ring in its groove, with corresponding proximal movement of the packing compression ring. This proximal longitudinal movement of the packing compression ring results in compression of the coaxial packing ring with a consequent tightening of the packing around the plunger. Alternatively, when a packing assembly that does not include a snap ring is inserted into the packing area, the packing compression ring itself contacts the adjusting ring. Further (distal) advance of the packing assembly after such contact compresses the coaxial packing ring with similar tightening of the packing around the plunger.

Because of the shallow taper of at least a distal portion of its outer surface (preferably in the range of 0.5 to 3 degrees) and the circumferential elastomeric seal present in a groove on a proximal portion of that surface or within the cylinder bore, a tapered cartridge packing assembly will maintain an effective seal with a plunger pump housing during longitudinal sliding movement within the housing. When a snap ring is present, such movement is preverably less than or equal in magnitude to the snap ring groove width. Thus, as described above, the degree of tightening of packing around a plunger may be adjusted by varying the distance a packing assembly is advanced into a plunger pump housing of the present invention after the snap ring or packing compression ring contacts the adjusting ring. Note that during advance and withdrawal of a packing assembly, the tapered portion tends to maintain alignment with a cylinder bore, thus minimizing any tendency to bind.

Note also that distal advance of a tapered packing assembly or tapered packing and gland nut assembly of the present invention is preferably limited by the snap ring or, when the snap ring is absent, the gland nut shoulder, rather than by the assembly being wedged tightly into the tapered recess of a cylinder bore packing area. These complementary provisions to limit distal advance also act to minimize binding of the assembly in the tapered recess. Thus, withdrawal of a tapered packing assembly should be substantially free of binding while drag due to packing compression is substantially reduced as the assembly is withdrawn and the snap ring and/or the packing compression ring becomes free to move distally to relieve compression of the packing ring. These effects combine to make changing of packing with a plunger in the cylinder bore practical in the field.

BRIEF DESCRIPTION OF THE DRAWINGS

FIG. 10B schematically illustrates a Y-block plunger pump housing similar to that in FIG. 10A except that the integral suction valve retainer arm has been replaced by a spoked suction valve spring retainer ring.

FIG. 10C schematically illustrates a plan view of a spoked suction valve spring retainer ring.

FIG. 10D schematically illustrates a cross-sectional view of the spoked suction valve spring retainer ring of FIG. 10C.

DETAILED DESCRIPTION

Figure 1:
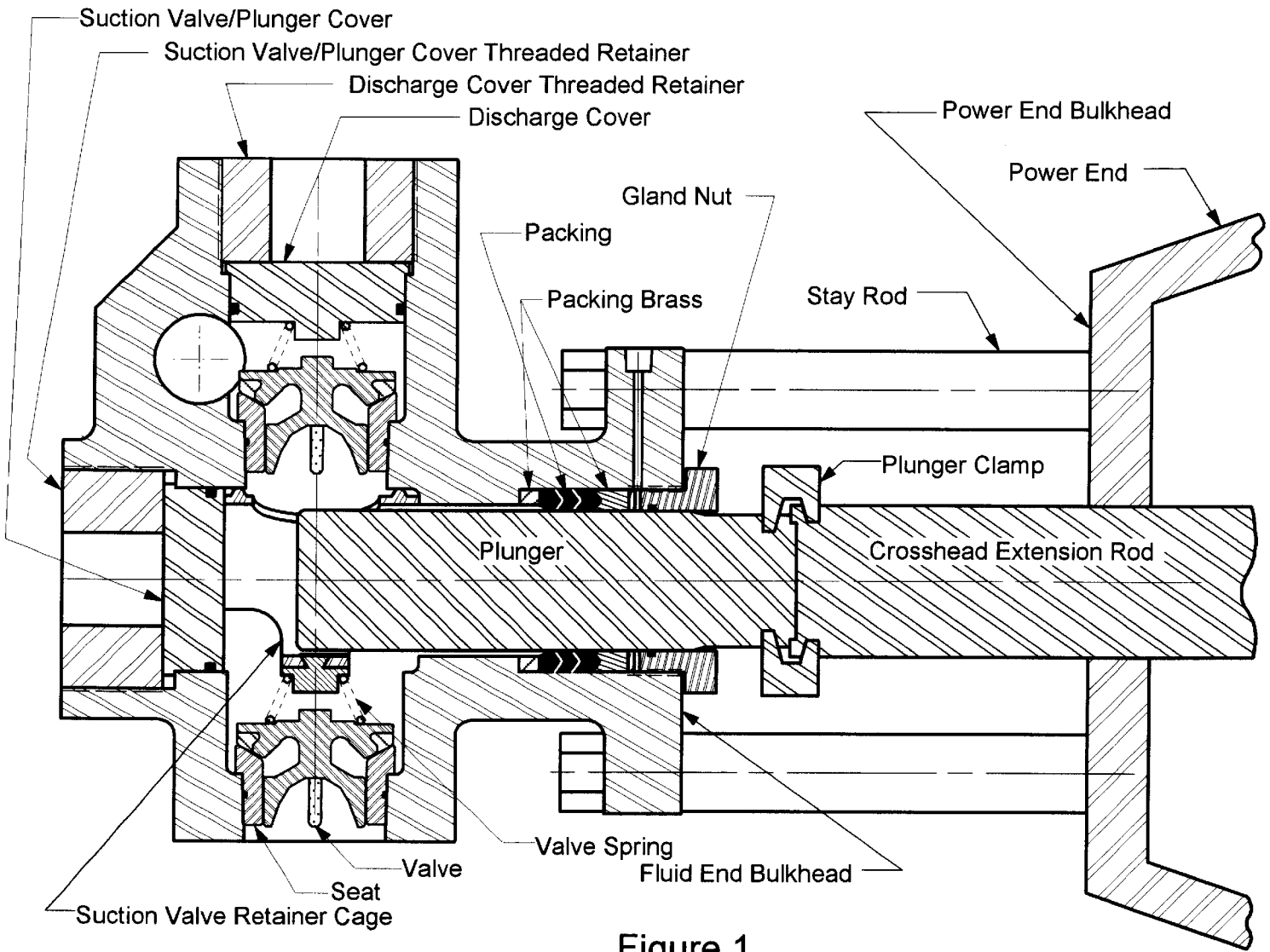
FIG. 1 is a cross-sectional schematic view of a conventional plunger pump fluid section housing showing its connection to a power section by stay rods.

FIGS. 9A–9D schematically illustrate cross-sectional views of a Y-block plunger pump housing 50 of the present invention. The housing 50 comprises an integral suction valve spring retainer arm 125, as well as a suction valve bore 110 having a substantially circular cross-section and a first centerline 115. A discharge valve bore 112 of housing 50 has a substantially circular cross-section and a second centerline 113. Discharge valve bore 112 intersects suction valve bore 110 in such a manner that first centerline 115 is coplanar with and intersects second centerline 113 at a reference point 109. First centerline 115 and second centerline 113 subtend a first obtuse angle 122.

Figures 9A, 9B, 9C, 9D:
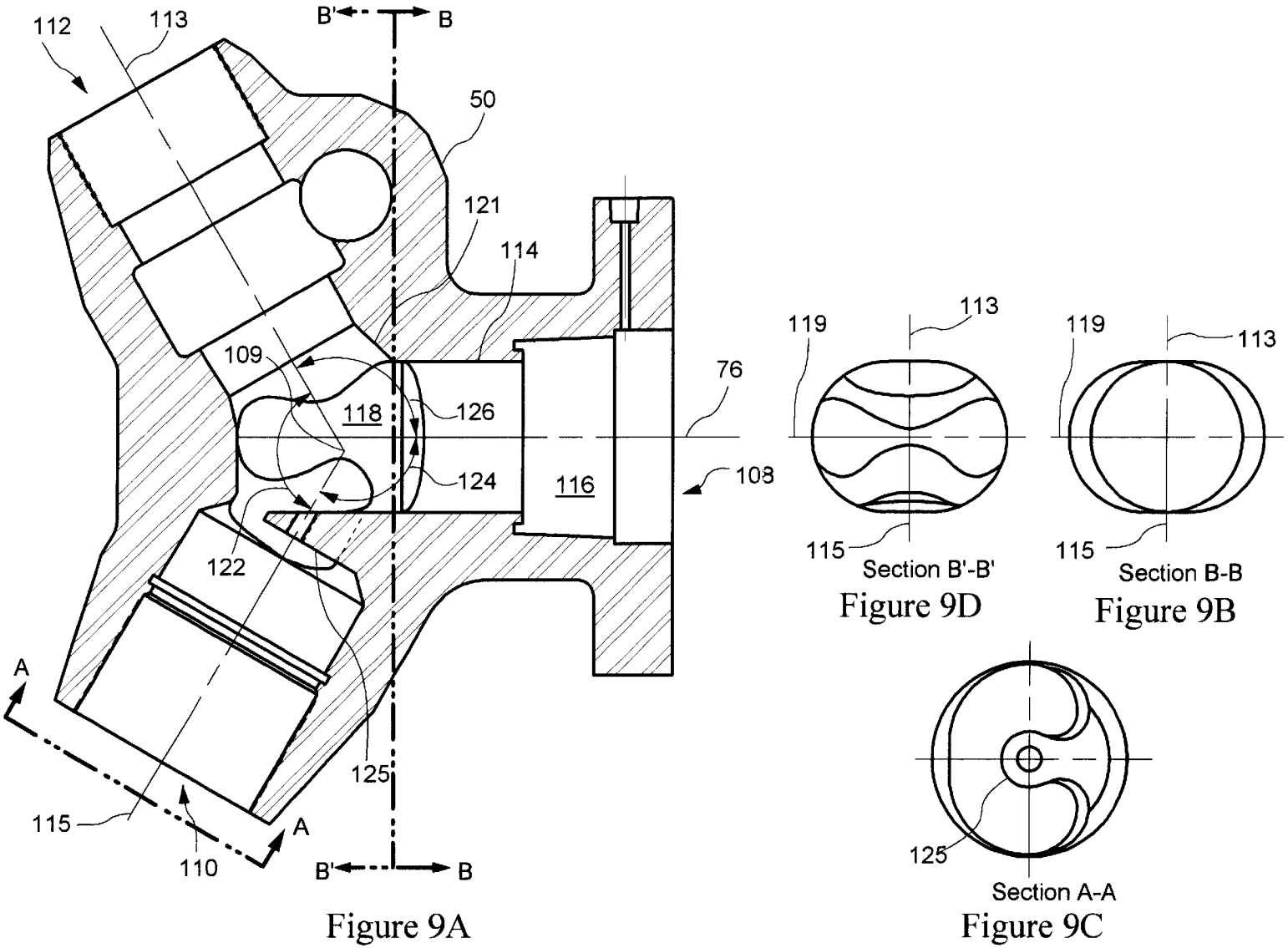
FIGS. 9A–9D schematically illustrates a cross-sectional views of a Y-block plunger pump housing incorporating an integral suction valve retainer arm, an oblong distal cylinder bore portion, and provision for insertion of a tapered packing cartridge assembly.

A cylinder bore (or plunger bore) 108 intersects suction valve bore 110 and discharge valve bore 112, cylinder bore 108 having a proximal packing area 116, a right circular cylindrical area 114, and a distal transition area 118. Packing area 116 and right circular cylindrical area 114 each have substantially circular cross-sections and a (common) third centerline 76. Third centerline 76 intersects first centerline 115 and second centerline 113 at or near reference point 109. Second centerline 113 and third centerline 76 subtend a second obtuse angle 126, and first centerline 115 and third centerline 76 subtend a third obtuse angle 124. Transition area 118 has a distal elongated (in the illustrated case, oblong) cross-section seen at section B-B. The elongated cross-section is substantially perpendicular to third centerline 76 and has a long axis 119 substantially perpendicular to the plane of first centerline 115, second centerline 113, and third centerline 76. Internal edges corresponding to intersections of bores 110, 112 and 108 are chamfered 121. FIGS. 9B–9D schematically illustrate the indicated cross-sections of the plunger pump housing of FIG. 9A.

Figure 9E:
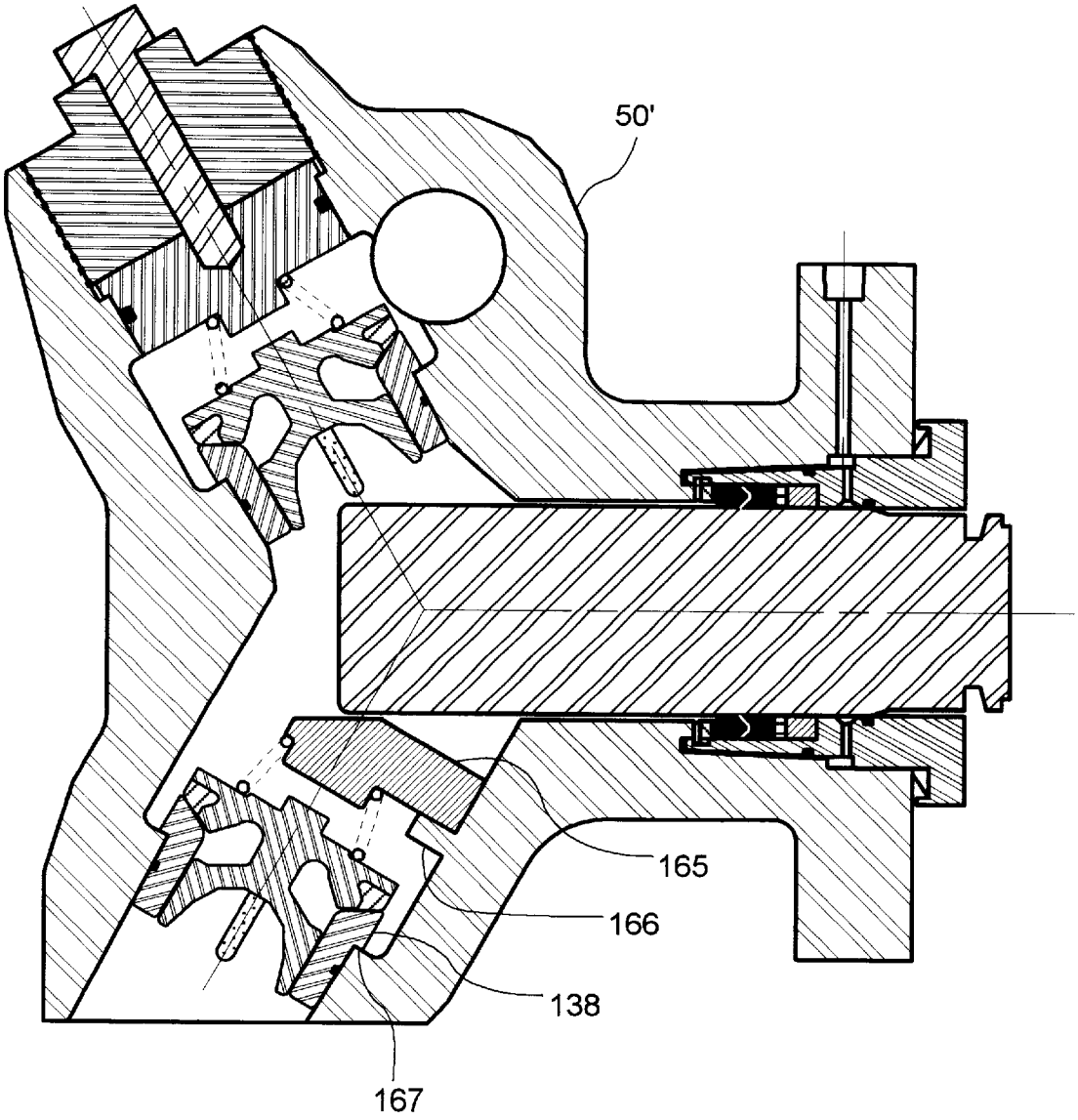
FIG. 9E schematically illustrates a cross-section of a Y-block plunger pump housing in which the integral suction valve retainer arm of FIG. 9A is replaced by a removable suction valve retainer arm, and the suction valve seat rests against an internal retainer ledge rather than a threaded valve seat retainer.

FIG. 9E schematically illustrates a cross-section of a Y-block plunger pump housing 50' in which integral suction valve spring retainer arm 125 of FIG. 9A, which is relatively difficult to machine, is replaced by a (simpler) removable suction valve spring retainer arm 165 that is bolted or otherwise removably attached to an internal suction bore lip 166. Suction valve seat 138 rests against an internal retainer ledge 167 rather than a threaded suction valve seat retainer. This design reduces the size and weight of pump housing 50' compared to pump housing 50. Further, elimination of the circumferential threads that would otherwise support a threaded suction valve seat retainer (as in, for example, pump housing 50) means that the stress-raising effects of those circumferential threads are also eliminated in pump housing 50'.

The advantageous placement of suction valve seat 138 in pump housing 50' as described above is not possible in a conventional Y-block pump housing. In such a pump housing, valve seat 138 and its associated valve body can not be inserted via the plunger bore and then rotated into the suction bore because there is insufficient clearance. But if the distal plunger bore is oblong, as in the present invention, placement of a suction valve body and its valve seat in the suction bore via the plunger bore is possible.

Figure 10A:
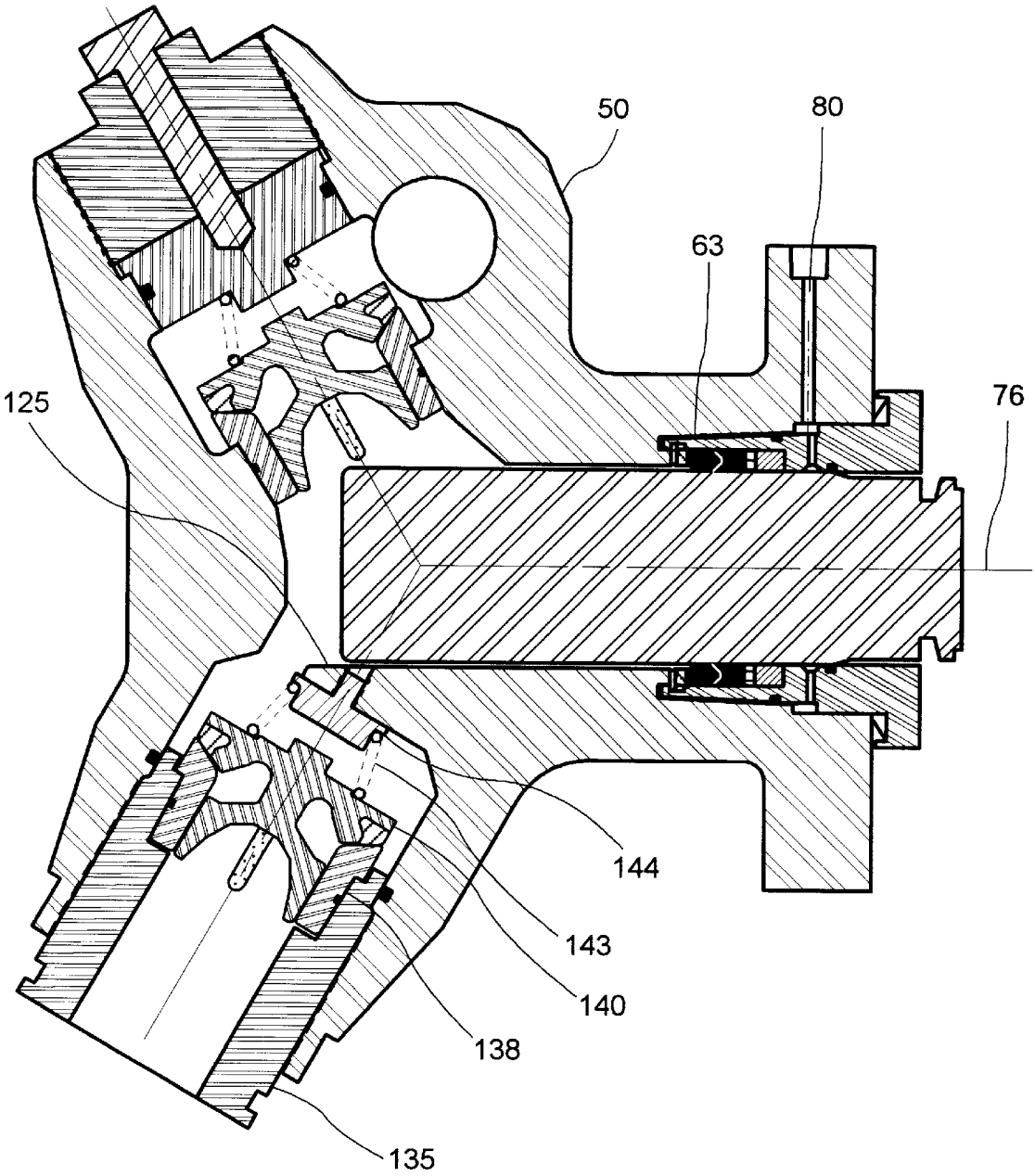
FIG. 10A schematically illustrates a cross-sectional view of a Y-block plunger pump housing similar to that in FIG. 9A, but with suction and discharge valves, as well as a one-piece plunger and tapered cartridge packing and gland nut assembly, in place.

FIG. 10A schematically illustrates a cross-sectional view of a Y-block plunger pump housing similar to that in FIG. 9A, but with suction and discharge valves, as well as a one-piece plunger and tapered cartridge packing and gland nut assembly, in place. Note that integral suction valve spring retainer arm 125, suction valve spring retainer 144, and suction valve spring 143 act together to exert force tending to seal suction valve body 140 against suction valve seat 138. Suction valve seat 138, in turn, is supported in pump housing 50 by threaded suction valve seat retainer 135.

FIG. 10B schematically illustrates a Y-block plunger pump housing 50" similar to housing 50 in FIG. 10A except that integral suction valve spring retainer arm 125 has been replaced by spoked suction valve spring retainer ring 155. Retainer ring 155, which is shown in plan view in FIG. 10C and in cross-sectional view in FIG. 10D, is held in place by a suction valve spring 143, which is supported in turn by suction valve body 140, suction valve seat 138, and threaded suction valve seat retainer 135. When suction valve spring 143, suction valve body 140, suction valve seat 138, and threaded suction valve seat retainer 135 are removed for maintenance, retainer ring 155 is held in place by friction imparted by peripheral O-ring 156.

Figure 10E:
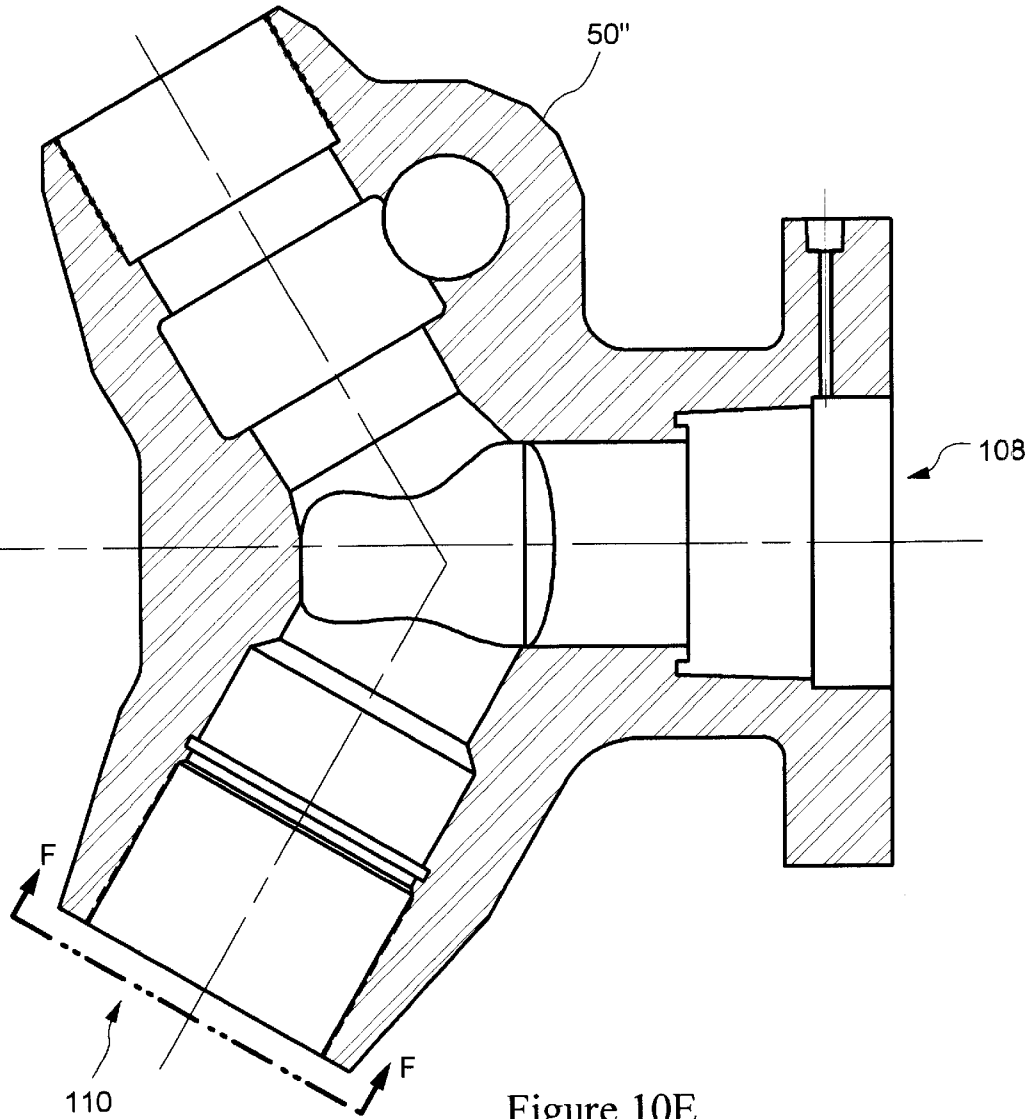
FIG. 10E schematically illustrates a cross-sectional view of a Y-block plunger pump housing similar to that of FIG. 10B.
Figure 10F:
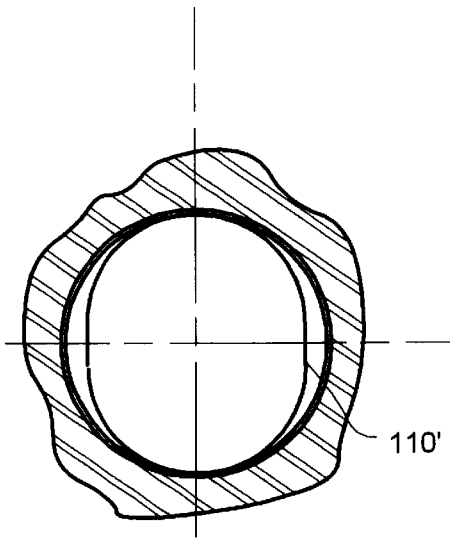
FIG. 10F schematically illustrates the indicated cross-sectional view of a Y-block plunger pump housing similar to that in FIG. 10E.

FIG. 10E schematically illustrates a cross-sectional view of Y-block plunger pump housing 50" of FIG. 10B. The plunger bore 108 of housing 50" is oblong distally as previously described. Note, however, that the suction bore 110' (shown in cross-sectional view in FIG. 10F) is also oblong distally. Computer finite element stress analysis has verified that stress is actually lower for this configuration as compared to the configuration with either integral suction valve retainer arm 125 or removable suction valve retainer arm 165.

Figure 10G:
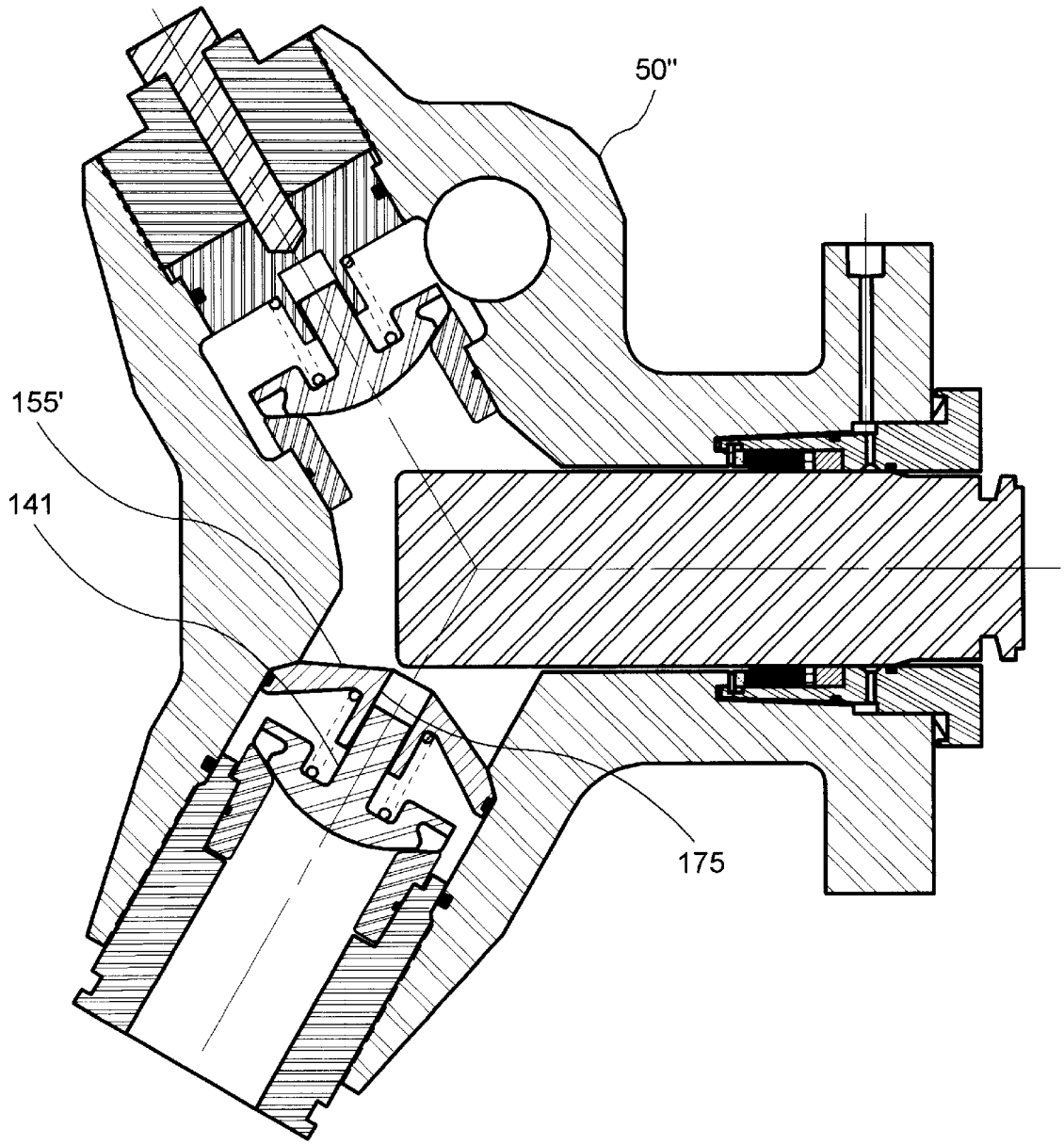
FIG. 10G schematically illustrates a cross-sectional view of a Y-block plunger pump housing similar to that in FIGS. 10B and 10E, but including top stem guided suction and discharge valves.

FIG. 10G schematically illustrates a cross-sectional view of a Y-block plunger pump housing 50" similar to that in FIG. 10E, but including top stem guided suction and discharge valves as well as a one-piece plunger and tapered cartridge packing and gland nut assembly. The valves illustrated in FIG. 10G differ from those illustrated in FIG. 10B in the method of guiding the suction and discharge valve bodies. The valve bodies of FIG. 10B are guided by legs welded to the bottom of the valve body, as are many earlier valve bodies. But the design of FIG. 10G uses a top stem and guide rather than bottom guide legs.

The top stem guided valves of FIG. 10G are advantageous in that they have a relatively larger flow area, which reduces fluid pressure drop across the valve. Top stem guided valves also have relatively lower frictional fluid flow losses because of the lower surface area associated with the absence of guide legs in the fluid flow path.

Lower fluid flow friction losses are important in preventing cavitation, particularly on the suction side of a pump. Although top stem guided discharge valves have been used as illustrated in FIG. 10G for small pumps, it has been difficult to adapt them for use as suction valves. But the modified spoked suction valve spring retainer ring 155' illustrated in cross-section in FIG. 10G overcomes this difficulty. As shown in this illustration, a guide hole 175 placed in retainer ring 155' accepts top valve stem 141.

FIGS. 10G, 11 and 12A–12E schematically illustrate cross-sections of various tapered cartridge packing and gland nut assemblies installed in Y-block plunger pump housings of the present invention. For example, assembly 60 in FIG. 12A has a longitudinal axis and comprises a gland nut 22 and packing cartridge housing 62. Packing cartridge housing 62 has a distal end 64 and a proximal end 74, wherein the proximal end 74 is slightly distal to lubrication channel 87. When assembly 60 is installed in plunger pump housing 50, the longitudinal axis of assembly 60 is colinear with the above centerline 76 shown, for example, in the FIG. 10A.

Figure 12A:
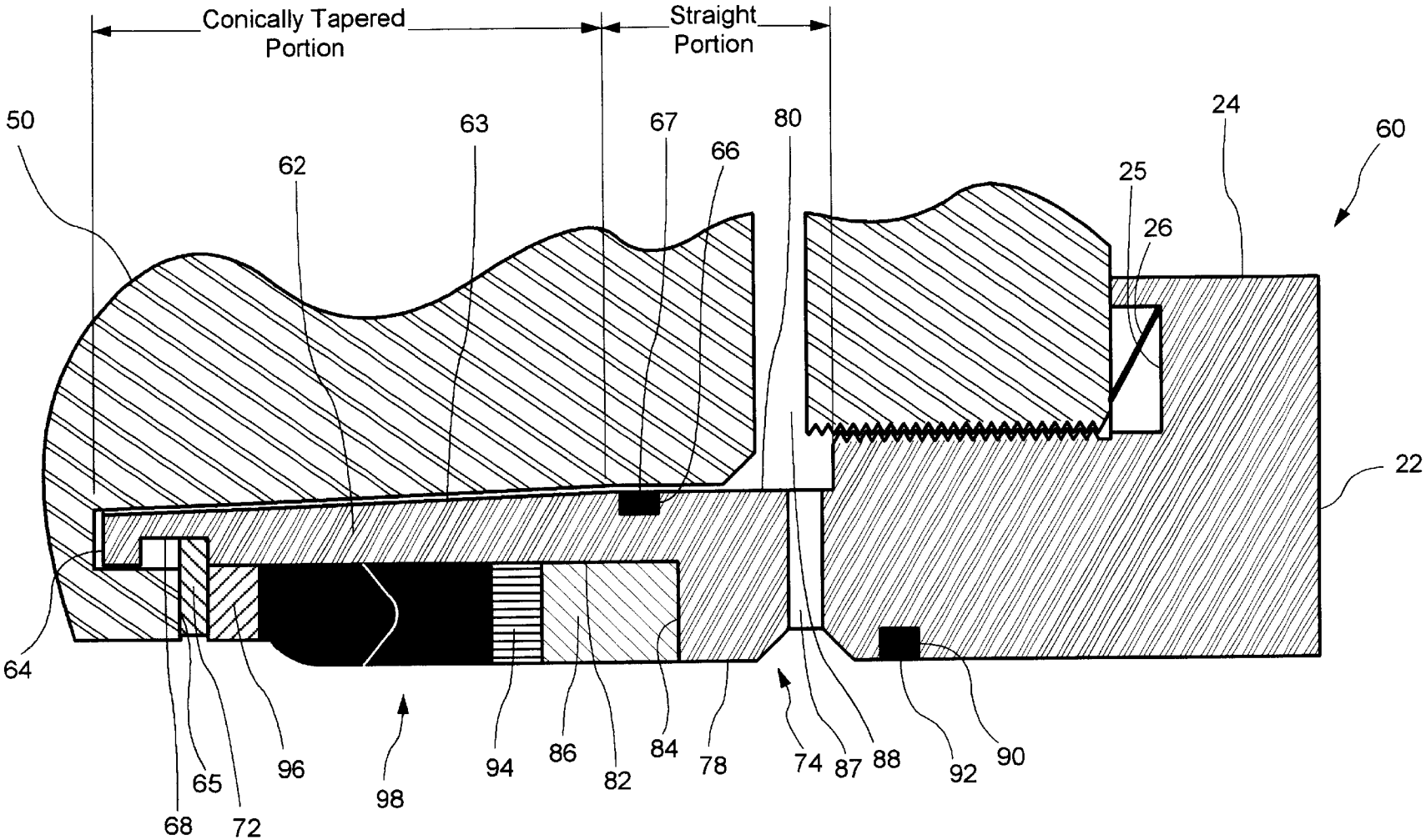
FIG. 12A schematically illustrates a further enlarged portion of FIG. 11, showing the extent of the right cylindrical outer surface portion of a tapered cartridge and gland nut assembly.
Figure 12B:
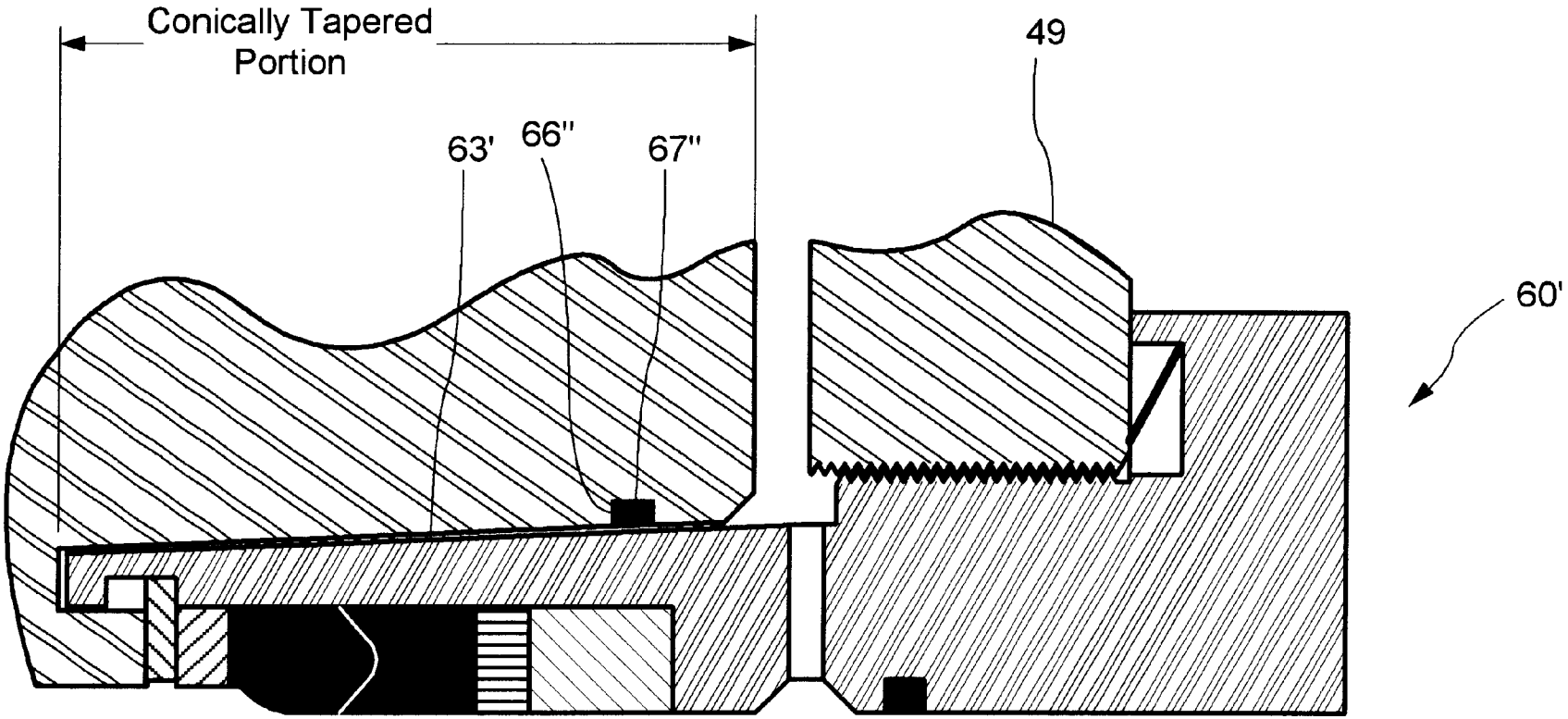
FIG. 12B schematically illustrates a portion of a plunger pump housing and a tapered packing cartridge and gland nut assembly in which the right cylindrical outer surface portion shown in FIG. 12A has been replaced by a continuation of the conically tapered outer surface, and the circumferential seal groove and its seal have been moved from the right cylindrical outer surface as shown in FIG. 12A to the inner surface of the portion of the pump housing into which the tapered packing cartridge and gland nut assembly is inserted.

Packing cartridge housing 62, as shown in partial cross-section in FIG. 12A, has a length between distal end 64 and proximal end 74, and a substantially right cylindrical inner surface 78 having a first diameter. A right cylindrical outer surface 80 is substantially coaxial with inner surface 78 and extends distally from proximal end 74 for a portion of said cartridge housing length. And a conically tapered substantially coaxial outer surface 63 extends distally from said distal extent of said right cylindrical outer surface 80 to distal end 64. As shown in FIG. 10A, outer surface 63 tapers distally from right cylindrical outer surface 80 toward the longituidinal axis of assembly 60, which is collinear with longitudinal axis 76.

Returning to FIG. 12A, inner surface 78 is seen to have a substantially coaxial cylindrical recess 82 having a second diameter greater than said first diameter and extending from distal end 64 proximally to an internal stop 84. Cylindrical recess 82 has a substantially coaxial internal snap ring groove 68, groove 68 having a substantially uniform width and a third diameter greater than said second diameter.

In assembly 60, a threaded gland nut 22 is integral with proximal end 74 of packing cartridge housing 62. Gland nut 22 comprises a shoulder 24, a shoulder seal groove 25 and an internal seal groove 90. A seal 26 lies within seal groove 25 for sealing shoulder 24 against a plunger pump housing 50. A seal 92 fitted within internal seal groove 90 of gland nut 22 for sealing against a plunger.

A substantially coaxial snap ring 72 lies within snap ring groove 68 and has a thickness less than said snap ring groove width. Snap ring 72 has an inner diameter slightly greater than said first diameter, an outer diameter slightly less than said third diameter, and a longitudinal sliding fit within snap ring groove 68. In the preferred embodiment schematically illustrated in FIG. 12A, a substantially coaxial packing compression ring 96 is positioned within cylindrical recess 82, between snap ring 72 and a packing ring 98. Packing compression ring 96 has an inner diameter slightly greater than said first diameter and an outer diameter slightly less than said second diameter.

The substantially coaxial packing ring 98 lying within cylindrical recess 82 has an inner diameter substantially equal to said first diameter and an outer diameter substantially equal to said second diameter. Packing ring 98 is positioned within recess 82 between packing compression ring 96 and anti-extrusion ring 94. Anti-extrusion ring 94 comprises a deformable material having a close sliding fit over a plunger within assembly 60, allowing it to retard or eliminate proximal extrusion of material from packing ring 98 along the plunger surface. Hence, the inner diameter of anti-extrusion ring 94 is slightly less than said first diameter and its outer diameter is about equal to said second diameter.

Anti-extrusion ring 94 is positioned in recess 82 between packing ring 98 and bearing ring 86. Bearing ring 86, which comprises bearing alloy, has an inner diameter slightly less than said first diameter and an outer diameter substantially equal to said second diameter. In use, bearing ring 86 contacts internal stop 84 as well as anti-extrusion ring 94.

When assembly 60 is manufactured, snap ring 72 is preferably positioned maximally distally within snap ring groove 68, with substantially the entire length of recess 82 between snap ring 72 and internal stop 84 occupied by packing compression ring 96, packing ring 98, anti-extrusion ring 94, and bearing ring 86 as described above. Note that an anti-extrusion ring, a packing compression ring, and/or a bearing ring may be absent in certain preferred embodiments, and that packing ring 98 may comprise one or more coaxial component rings arranged longitudinally (that is, stacked like washers). As an example of a preferred embodiment, two such component rings of packing ring 98 are schematically illustrated in FIG. 12A.

As assembly 60 is advanced distally over a plunger 40 in Y-block plunger pump housing 50 (see, for example, FIG. 11), snap ring 72 encounters adjusting ring 65, which is a coaxial boss integral with housing 50 (returning, for example, to FIG. 12A). Continued distal advancement of assembly 60 will cause snap ring 72 to move proximally (longitudinally) within snap ring groove 68. In turn, proximally directed longitudinal sliding movement of snap ring 72 within snap ring groove 68 causes proximally directed longitudinal sliding movement of packing compression ring 96 with resultant compression of packing ring 98 and tighter sealing of the packing around a plunger lying within cartridge packing housing 62.

Conversely, if distally directed sliding movement of snap ring 72 within snap ring groove 68 is allowed, as during extraction of tapered cartridge packing and gland nut assembly 60 over a plunger 40 in a Y-block plunger pump housing 50, compressed packing ring 98 will tend to push snap ring 72 distally so as to relieve the compression. Such compression relief in packing ring 98 will loosen the seal of packing ring 98 around a plunger lying within cartridge packing housing 62, facilitating continued extraction of assembly 60.

Figure 13:
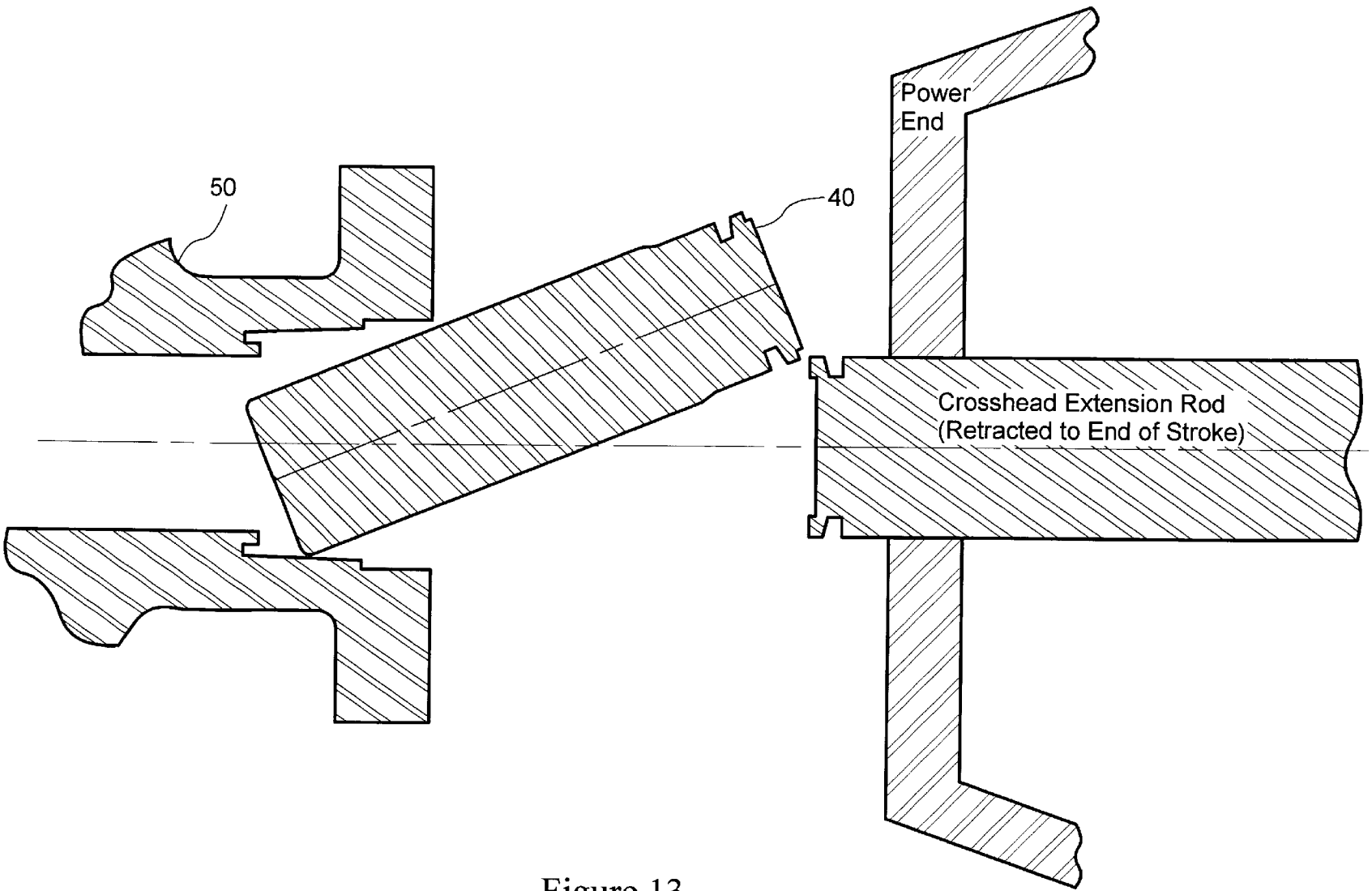
FIG. 13 schematically illustrates rotation of a plunger for insertion or removal in a Y-block plunger pump housing as in FIG. 9.

Following extraction of assembly 60 from plunger pump housing 50, a plunger 40 may be removed from plunger pump housing 50 as schematically illustrated in FIG. 13. As shown in FIG. 13, prior extraction of assembly 60 allows subsequent rotation of plunger 40 into space formerly occupied by assembly 60. This rotation provides sufficient clearance for removal of plunger 40 past power section components.

In addition to assembly 60, other embodiments of tapered cartridge packing and gland nut assemblies of the present invention also provide for removal of a plunger as schematically illustrated in FIG. 13. For example, tapered cartridge packing and gland nut assembly 60' (shown in partial cross-section in FIG. 12B) is similar to assembly 60 but differs in that the substantially coaxial right cylindrical outer surface 80 has been replaced by a proximal extension of conically tapered substantially coaxial outer surface 63, the extended conically tapered surface being labeled 63'. Additionally, assembly 60' does not include circumferential seal groove 66 with its elastomeric seal 67. Instead, assembly 60' is intended for use in a pump housing 49 that matches the conical taper of assembly 60' and that comprises an elastomeric seal 67" within an inner circumferential seal groove 66".

Tapered cartridge packing and gland nut assembly 61 (shown in partial cross-section in FIG. 12C) is similar to assembly 60 but differs in that snap ring groove 68 and snap ring 72 have been eliminated. Additionally, assembly 61 does not include circumferential seal groove 66 with its elastomeric seal 67. Instead, assembly 61 is intended for use in a pump housing 48 that matches the conical taper and cylindrical outer surface of assembly 61. In its proximal packing area, pump housing 48 is similar to pump housing 50 except that pump housing 48 comprises an elastomeric seal 67" within an inner circumferential seal groove 66".

When removing assembly 61 from pump housing 48 over a plunger 40 (not shown in FIG. 12C), for example, packing compression ring 96 and coaxial packing ring 98 may remain on the plunger because of the close fit of packing ring 98 on plunger 40. After removal of the tapered portion of assembly 61 that surrounds packing ring 98, however, ring 98 and any other components of assembly 61 that may remain around the plunger 40 will not impede its removal.

Figure 2:
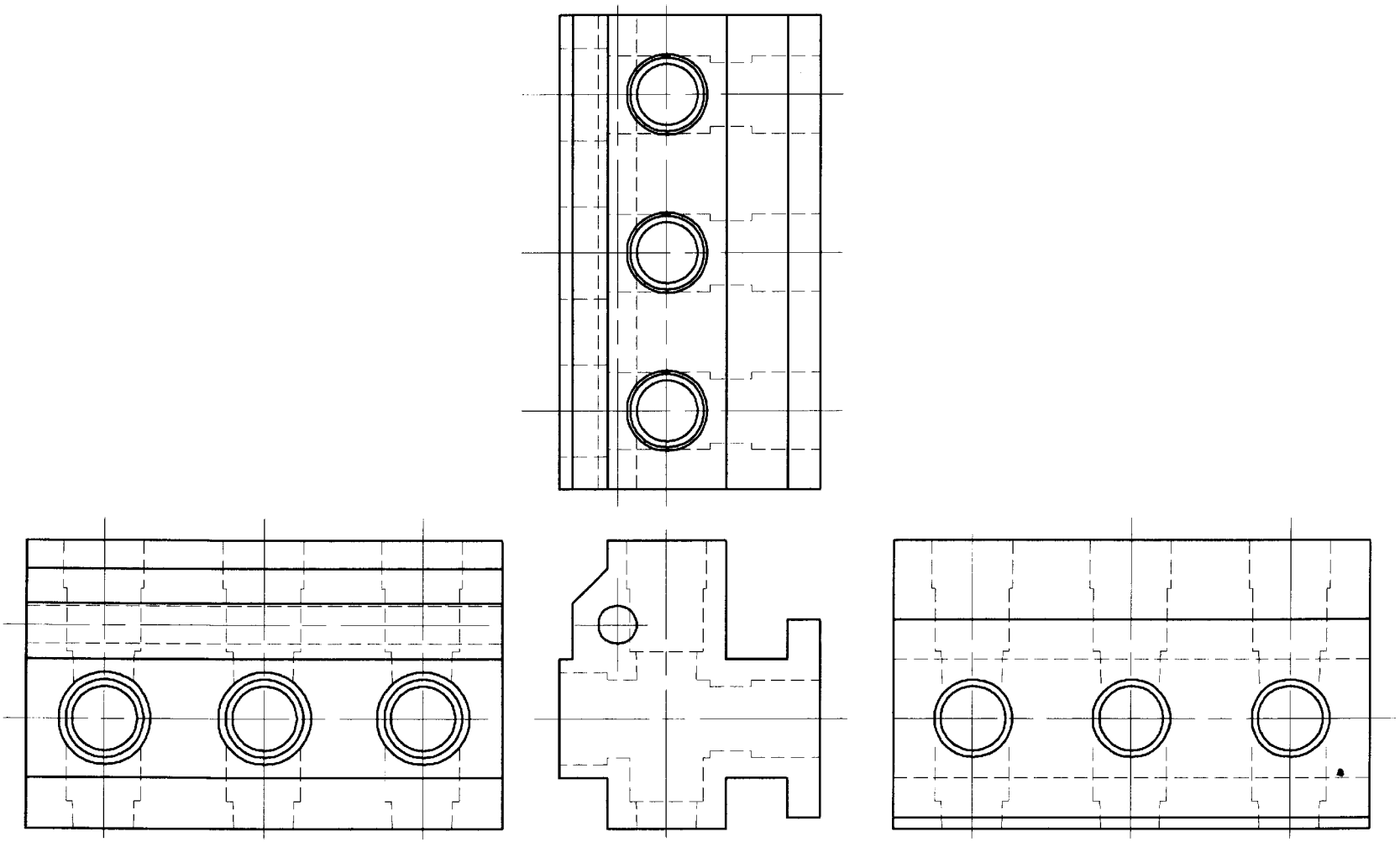
FIG. 2 schematically illustrates a conventional Triplex plunger pump fluid section.
Figure 3:
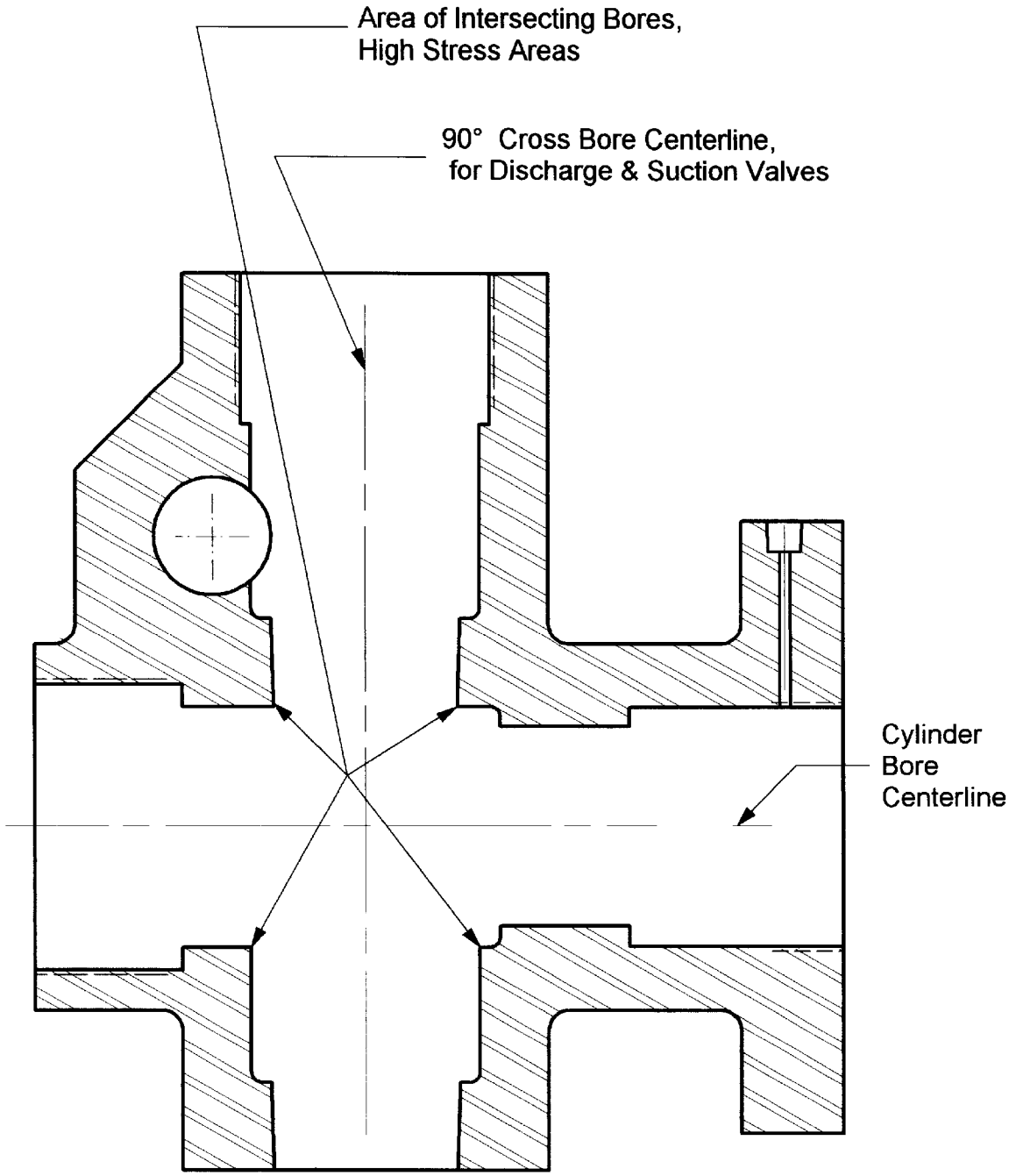
FIG. 3 is a cross-sectional schematic view of suction, plunger and discharge bores of a conventional plunger pump housing intersecting at right angles showing areas of elevated stress.
Figure 4:
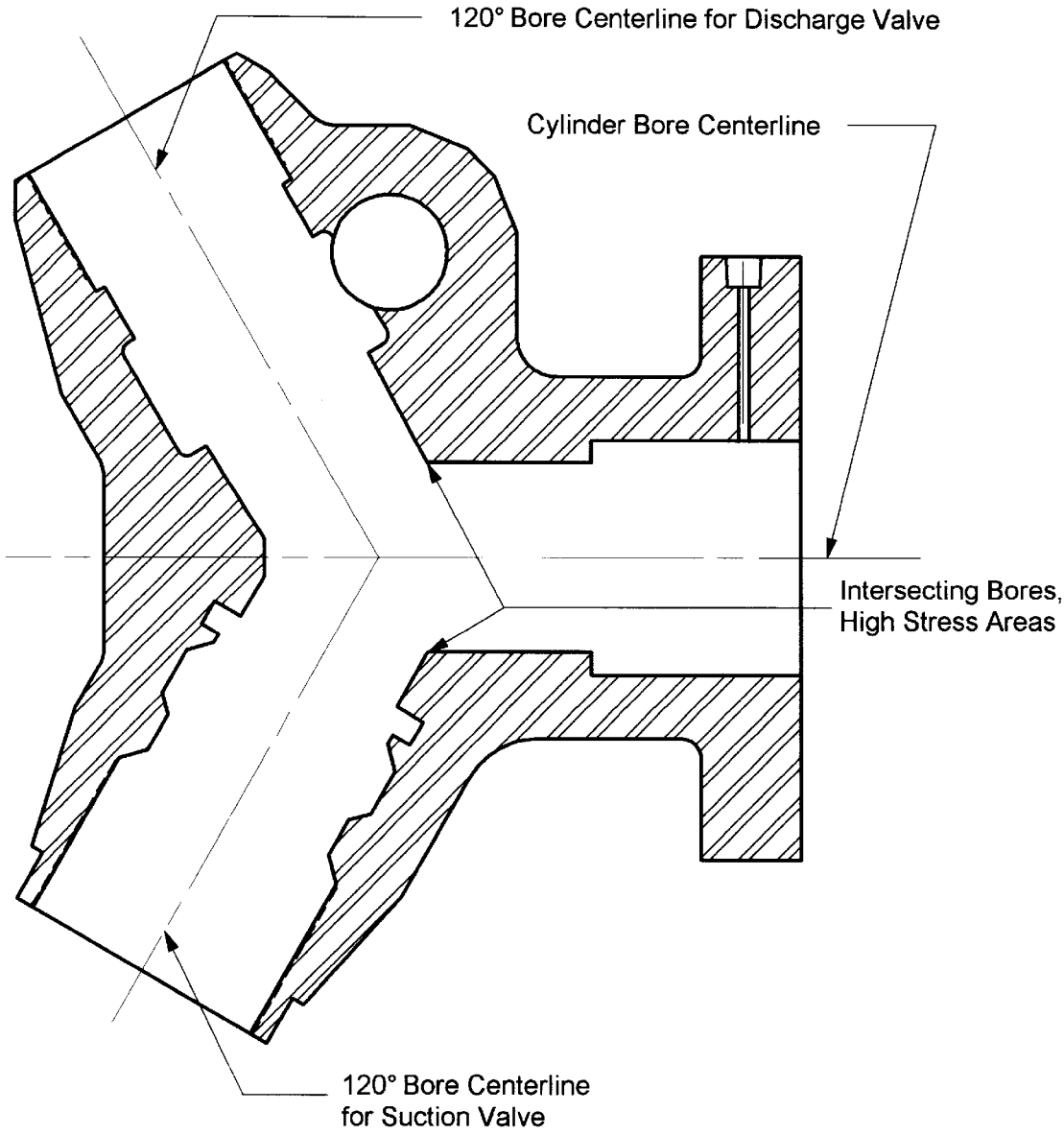
FIG. 4 is a cross-sectional schematic view of suction, plunger and discharge bores of a Y-block plunger pump housing intersecting at obtuse angles showing areas of elevated stress.
Figure 5:
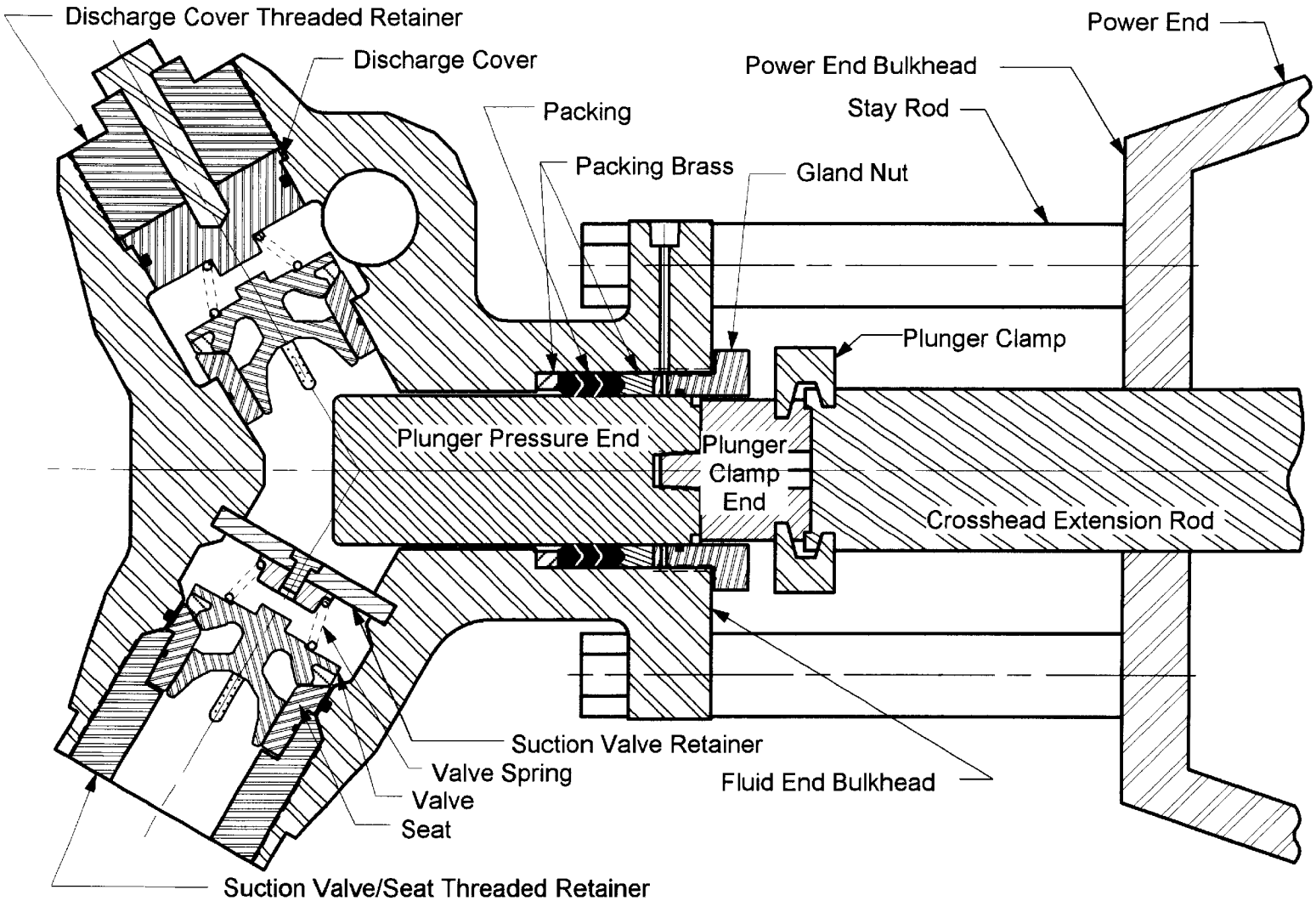
FIG. 5 is a cross-sectional schematic view similar to that in FIG. 4, including internal plunger pump components.
Figure 6:
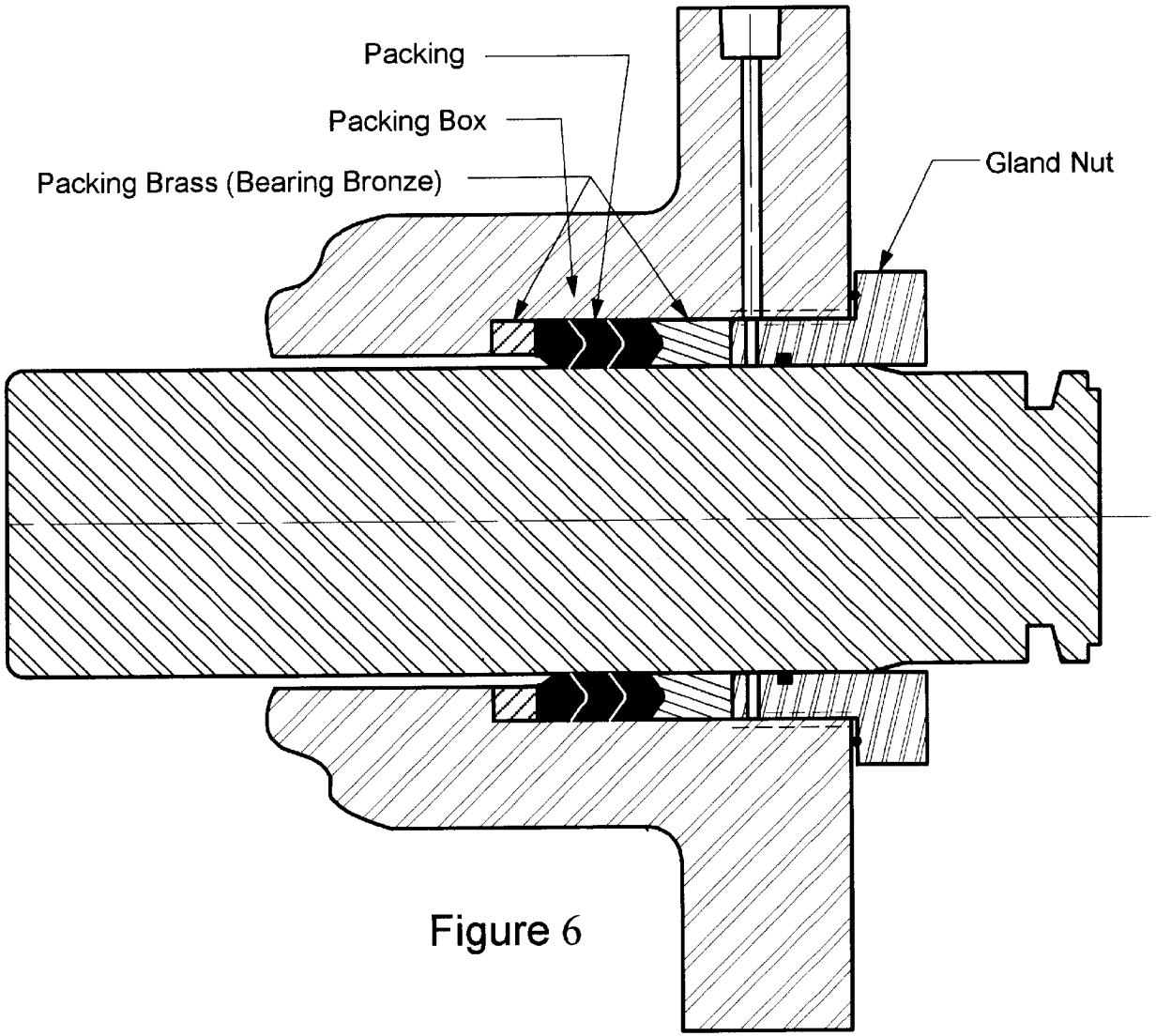
FIG. 6 is a partial cross-sectional schematic view of conventional plunger packing and packing brass.
Figure 7:
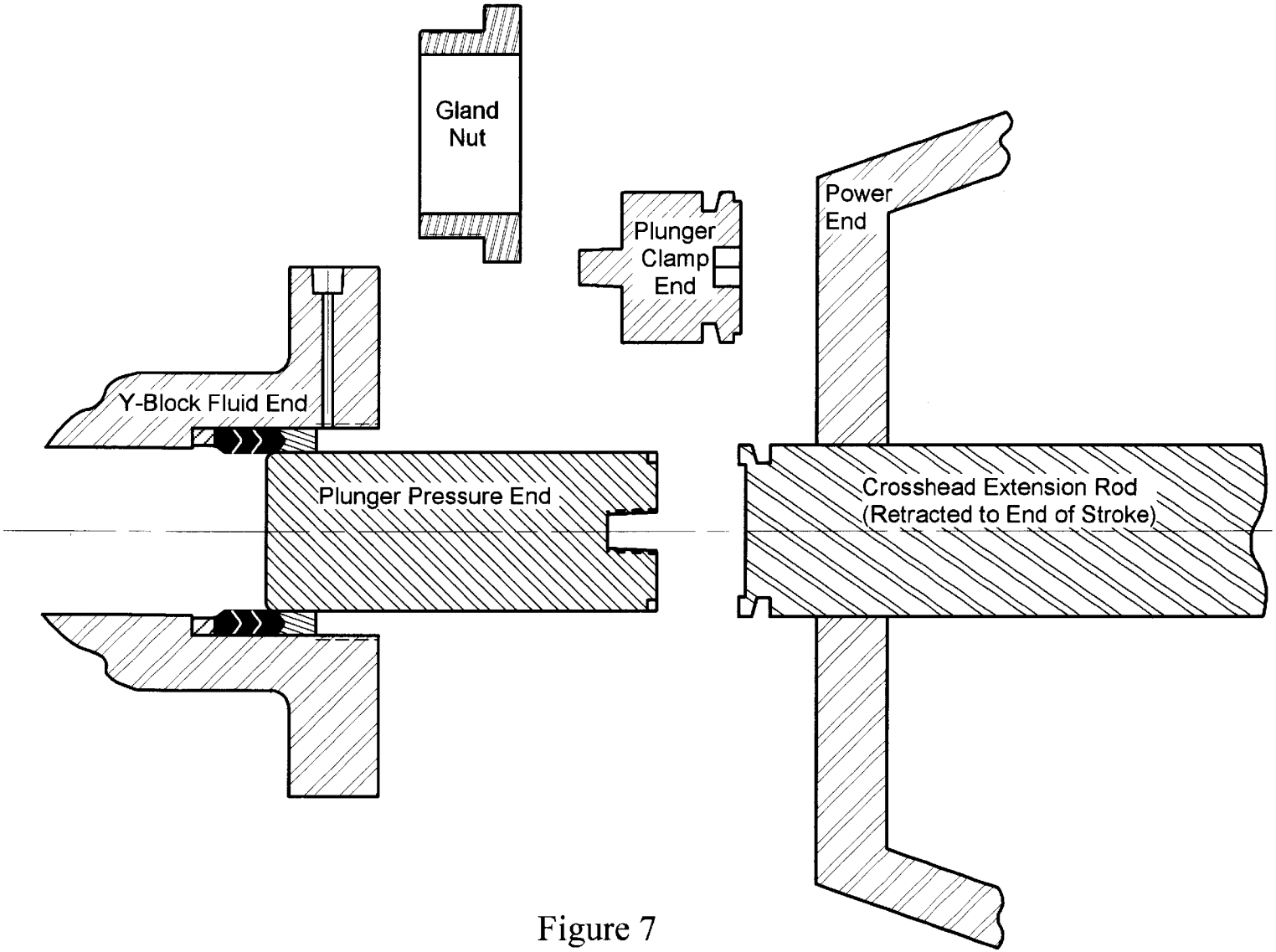
FIG. 7 schematically illustrates portions of a Y-block plunger pump housing, together with a gland nut and plunger parts, with the plunger pressure end within the packing box.
Figure 8:
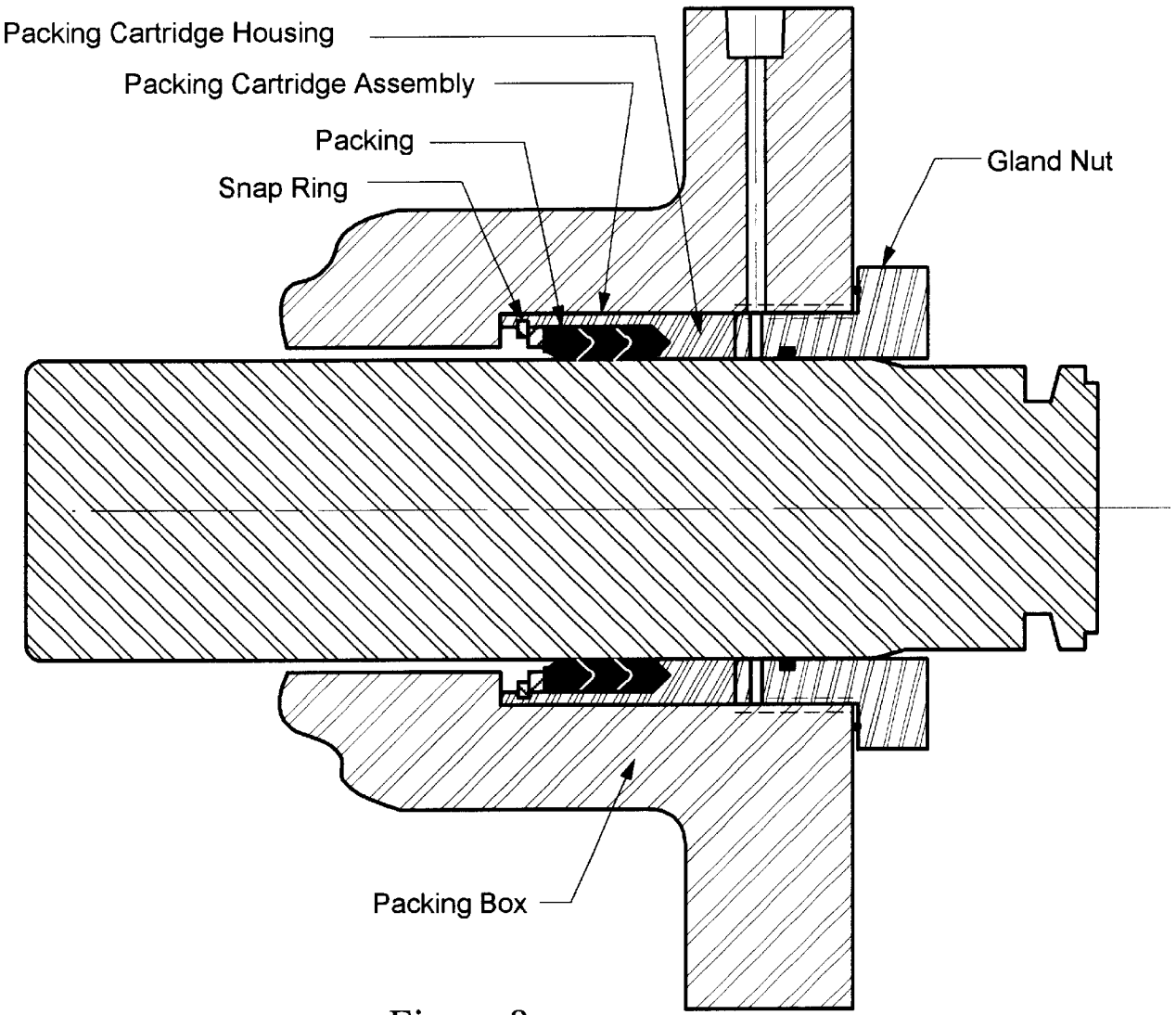
FIG. 8 schematically illustrates a partial cross-sectional view of a plunger pump housing, together with a conventional packing cartridge and gland nut.

Note that packing ring 98 may comprise a single segment or may preferably comprise two or more adjacent packing ring segments that fit together in a (commonly used) chevron configuration (see, for example, U.S. Pat. No. 4,878,815, incorporated herein by reference). The chevron configuration facilitates tightening of packing ring 98 over a plunger 40 as packing ring 98 is longitudinally compressed. Note, however, that the chevron packing rings of the '815 patent have a tapered outside diameter to fit inside a correspondingly tapered stuffing box (see FIG. 2 of the '815 patent). In contrast, packing ring 98 of the present invention does not have such a tapered outside diameter, since it is located within the substantially coaxial cylindrical recess of a packing cartridge housing.

Figure 12C:
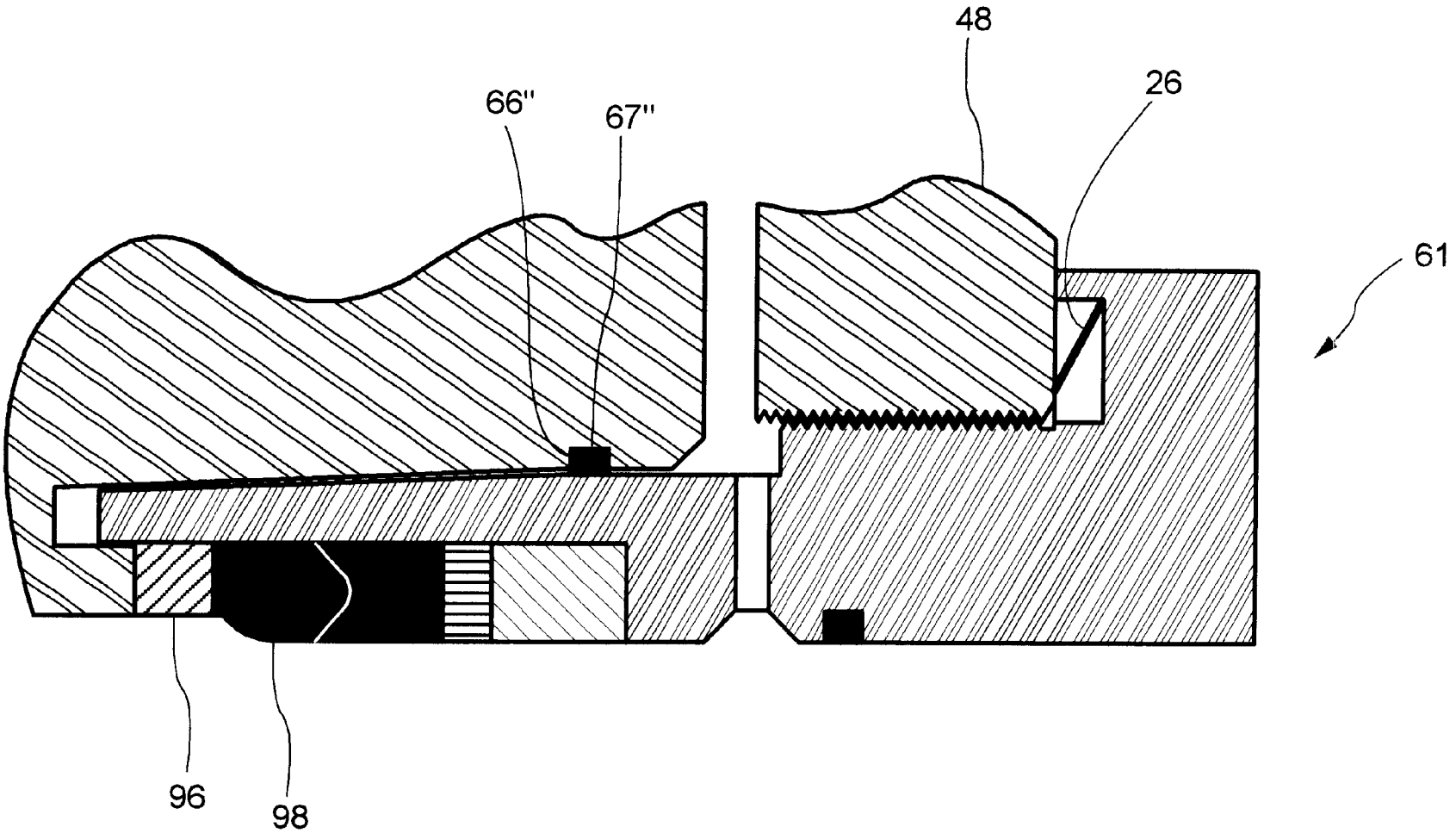
FIG. 12C schematically illustrates a portion of a plunger pump housing and a tapered packing cartridge and gland nut assembly in which the snap ring and snap ring groove shown in FIG. 12A have been eliminated.
Figure 12D:
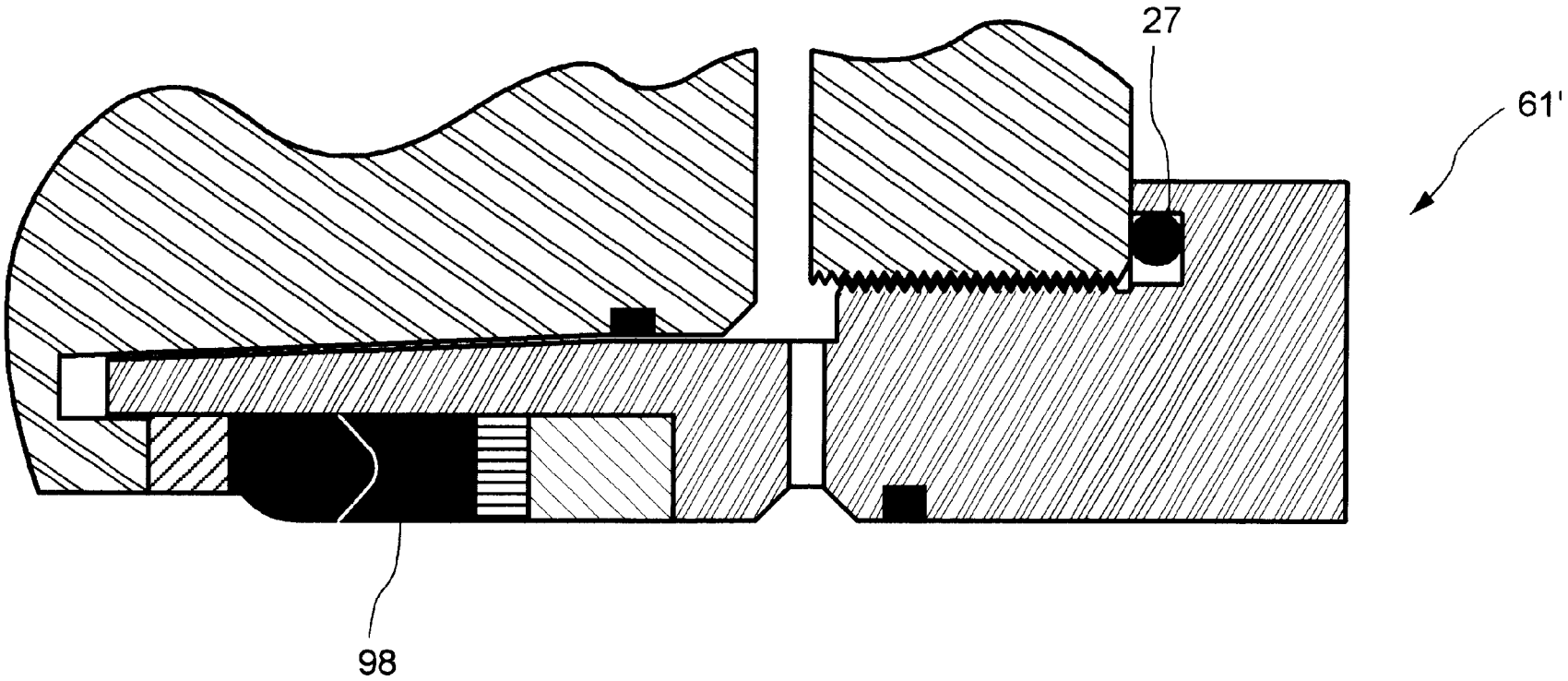
FIG. 12D schematically illustrates a portion of a plunger pump housing and a tapered packing cartridge and gland nut assembly in which the Bellville spring of FIG. 12C is replaced by an O-ring seal.
Figure 12E:
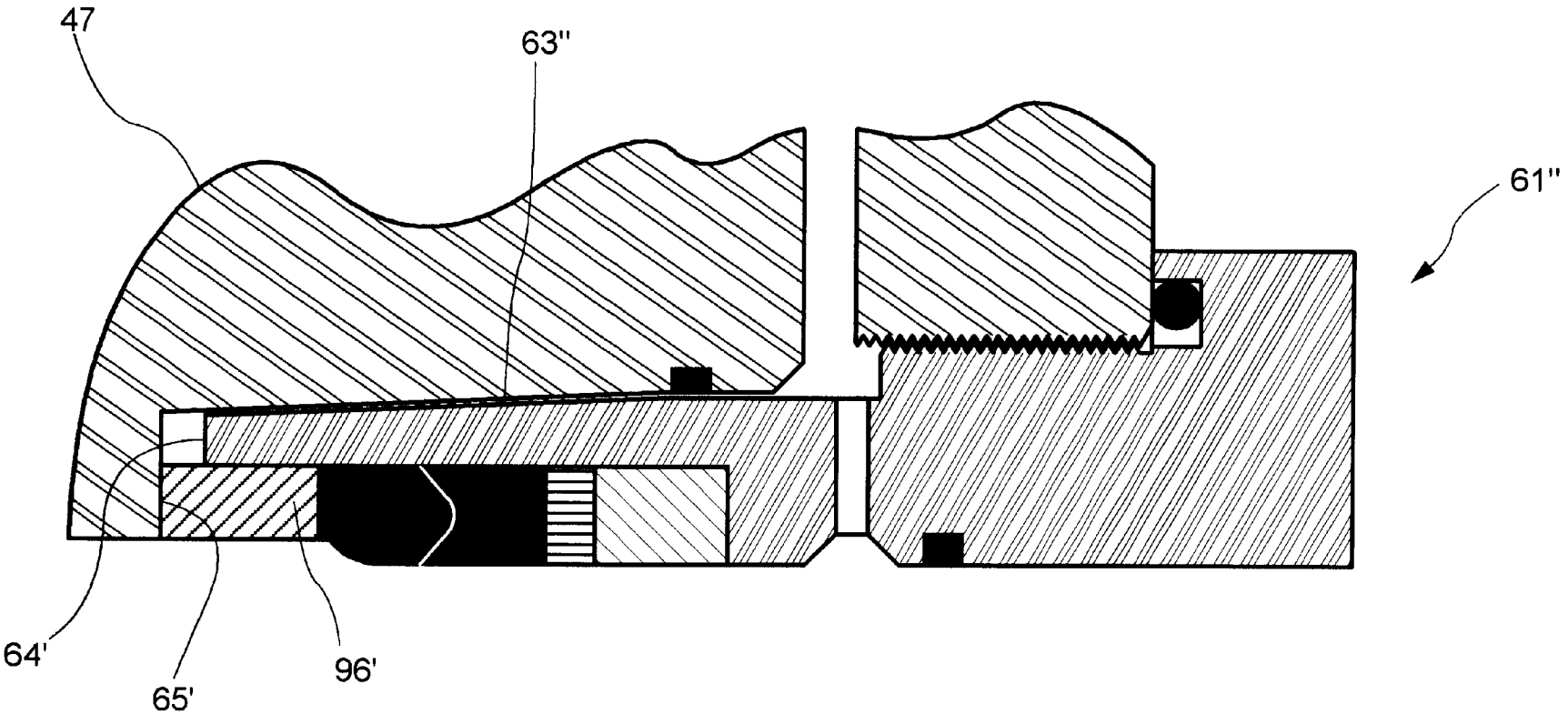
FIG. 12E schematically illustrates a portion of a plunger pump housing and a tapered packing cartridge and gland nut assembly in which the packing compression ring of FIG. 12D lies partially within the cylindrical recess.

Tapered cartridge packing and gland nut assembly 61' (shown in partial cross-section in FIG. 12D) is similar to assembly 61 in FIG. 12C but differs in that Bellville spring seal 26 is replaced by O-ring seal 27. O-ring seal 27 would generally provide less adjustment range for sealing a packing ring 98 around a plunger 40 than Bellville spring seal 26, but may be an acceptable alternative. Indeed, since the lube oil leaks that seals 26 and 27 are intended to stop are themselves relatively small, a tapered cartridge packing and gland nut assembly may be used without either such seal. The relatively viscous nature of lube oil and the relatively low lube oil pressures commonly used mean that some users may choose to accept leaks rather than tying to seal against them.

Tapered cartridge packing and gland nut assembly 61" (shown in partial cross-section in FIG. 12E) is similar to assembly 61 in FIG. 12C but differs in that packing compression ring 96' extends beyond distal end 64' of conically tapered outer surface 63". Assembly 61" is thus intended for use in a pump housing 47 in which adjusting ring 65' is a relatively shorter height coaxial boss than adjusting ring 65 in assembly 60, the lower limit of height for coaxial boss 65' being zero. Where the coaxial boss height is reduced to zero, machining of corresponding pump housing 47 would be simplified compared to machining of pump housing 48, 49 or 50 (each of which has a coaxial boss height greater than zero).

Figure 14A:
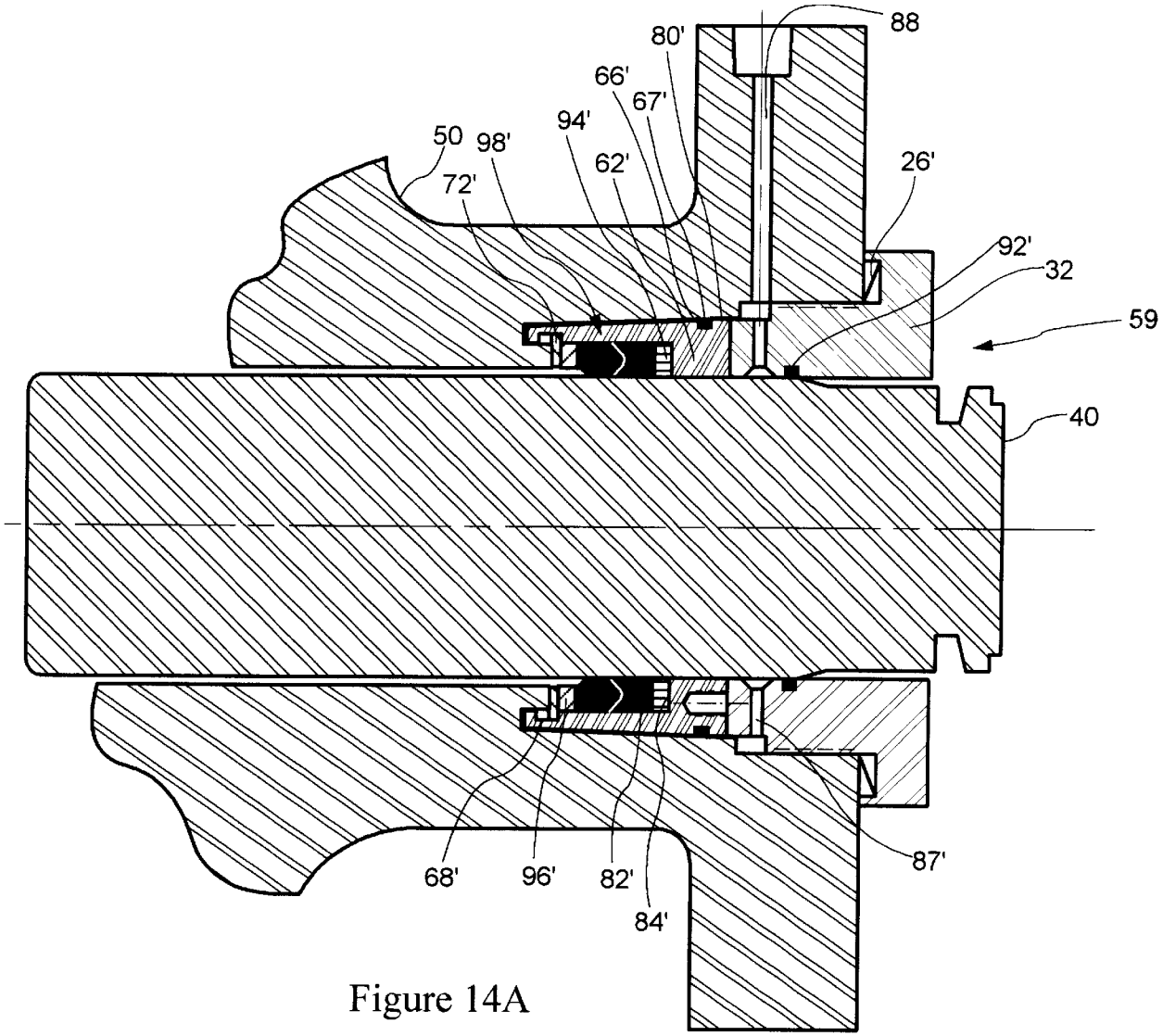
FIG. 14A schematically illustrates a partial cross-sectional view of a plunger pump housing of the present invention with a plunger, a tapered packing cartridge assembly, and a (separable) gland nut in place.

Several structures of assembly 60 above correspond to analogous structures in the embodiment of the invention schematically illustrated in FIG. 14A. FIG. 14A schematically illustrates a separable tapered cartridge packing and gland nut assembly 59 comprising tapered cartridge packing housing 62' in use with a separate (removable) gland nut 32.

At least one and preferably a plurality of radial lubricating channels 88 in housing 50 communicate with at least one and preferably a plurality of corresponding channels 87' within gland nut 32, allowing for lubrication of a plunger within packing cartridge housing 62'. After entering through channels 88 and 87', plunger lubricant is prevented from leaking distally by elastomeric seal 67' and packing ring 98', while elastomeric seal 92' and Bellville spring seal 26' prevent proximal leakage.

At least one circumferential seal groove 66' preferably lies in right cylindrical outer surface 80', and an elastomeric seal 67' is fitted within each circumferential seal groove 66' to seal against fluid leakage around the outer surfaces of cartridge packing housing 62'. Note that the sealing function of elastomeric seal 67' may be replaced by a similar function achieved with one or more circumferential seal grooves, with corresponding elastomeric seal(s), that may alternatively lie in pump housing 50 instead of on the outer surface of cartridge packing housing 62'.

Since cartridge packing housing 62' comprises bearing alloy, there is no need in the embodiment of FIG. 14A for a substantially coaxial bearing ring 86 (as shown, for example, in FIG. 12A) within cylindrical recess 82'. However, preferred embodiments of the invention may comprise a substantially coaxial anti-extrusion ring 94' lying within cylindrical recess 82' between packing ring 98' and internal stop 84'. Anti-extrusion ring 94' comprises a deformable material having a close sliding fit over a plunger within assembly 59. Hence, the inner diameter of anti-extrusion ring 94' is slightly less than said first diameter and its outer diameter is about equal to said second diameter.

A substantially coaxial snap ring 72' lies within snap ring groove 68' and has a thickness less than said snap ring groove width. Snap ring 72' has an inner diameter slightly greater than said first diameter, an outer diameter slightly less than said third diameter, and a longitudinal sliding fit within snap ring groove 68'. A substantially coaxial packing compression ring 96' is positioned within cylindrical recess 82', between snap ring 72' and packing ring 98' and preferably contacting snap ring 72'. Packing compression ring 96' has an inner diameter slightly greater than said first diameter and an outer diameter slightly less than said second diameter.

A substantially coaxial packing ring 98' lies within cylindrical recess 82'. Packing ring 98' has an inner diameter substantially equal to said first diameter, an outer diameter substantially equal to said second diameter, and sufficient length to substantially fill cylindrical recess 82' between anti-extrusion ring 94' (when present) and packing compression ring 96' (when present) when snap ring 72' is positioned maximally distally within snap ring groove 68'. Note that an anti-extrusion ring and/or a packing compression ring may be absent in certain preferred embodiments, and that coaxial packing ring 98' may comprise one or more coaxial component rings arranged longitudinally (that is, stacked like washers). As an example of a preferred embodiment, two such component rings are schematically illustrated in FIG. 14A.

Figure 11:
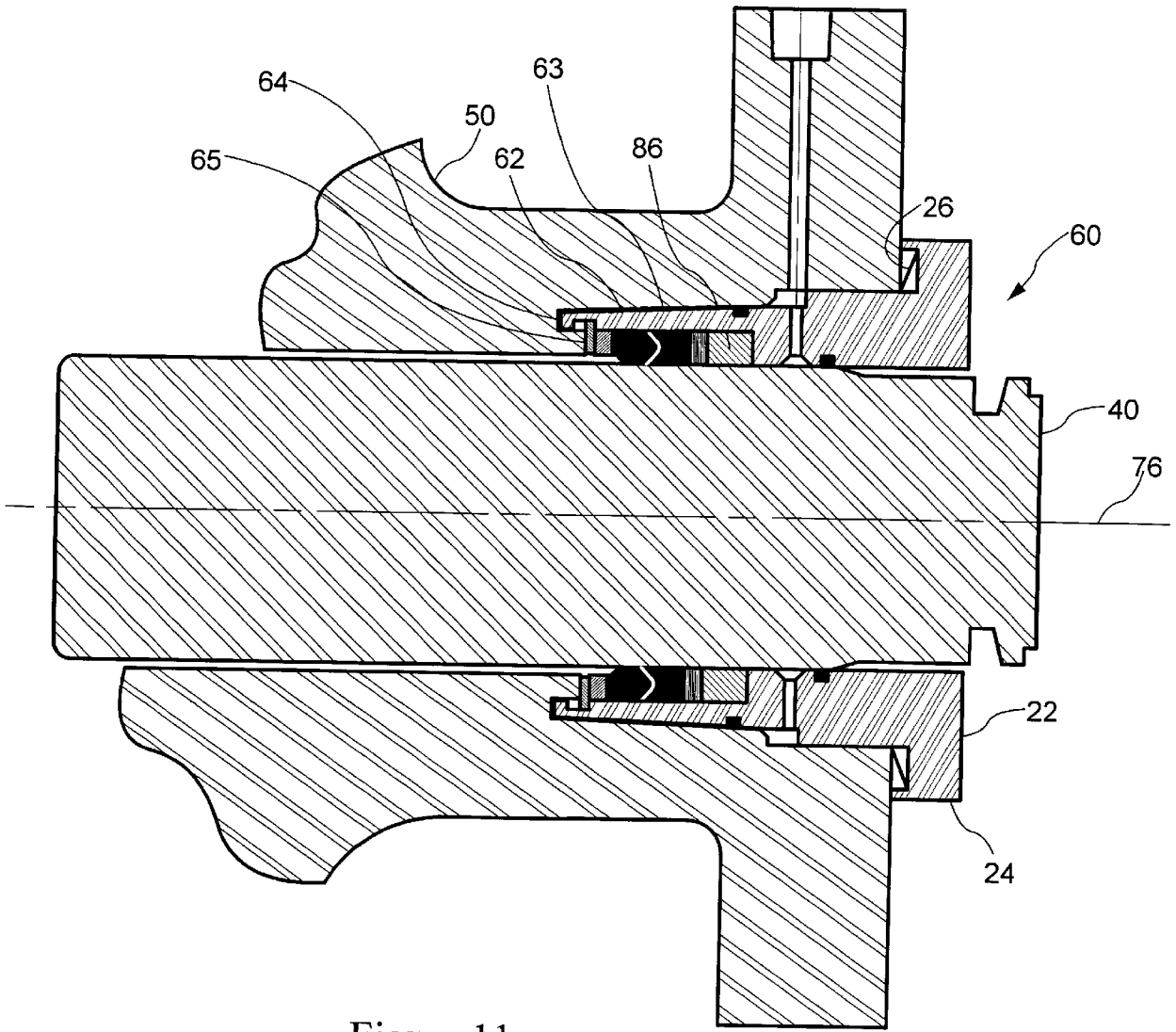
FIG. 11 schematically illustrates an enlarged partial cross-sectional view of a plunger pump housing as in FIG. 10, with a one-piece plunger and a tapered packing cartridge and gland nut assembly in place.

FIG. 14A is analogous to FIG. 11 but differs in that it schematically illustrates an embodiment of the invention wherein gland nut 22, an integral part of tapered cartridge packing and gland nut assembly 60, is replaced by removable gland nut 32. Note that when gland nut 32 is removed from plunger pump housing 50, leaving cartridge packing housing 62' in place, proximal traction on plunger 40 will be required to extract housing 62' from plunger pump housing 50. In this configuration, cartridge packing housing 62' will tend to follow plunger 40 as it is withdrawn proximally because the friction of packing ring 98' on a proximally moving plunger 40 will usually exceed the friction of circumferential seal 67' on plunger pump housing 50. However, when packing ring 98' is well worn, its friction force on plunger 40 may be so reduced that cartridge packing housing 62' may not follow plunger 40 as it is withdrawn proximally. Such a failure to withdraw cartridge packing housing 62' will prevent removal of plunger 40 because plunger 40 will not be rotatable as shown in FIG. 13 if cartridge packing housing 62' remains installed in pump housing 50.

Figure 14C:
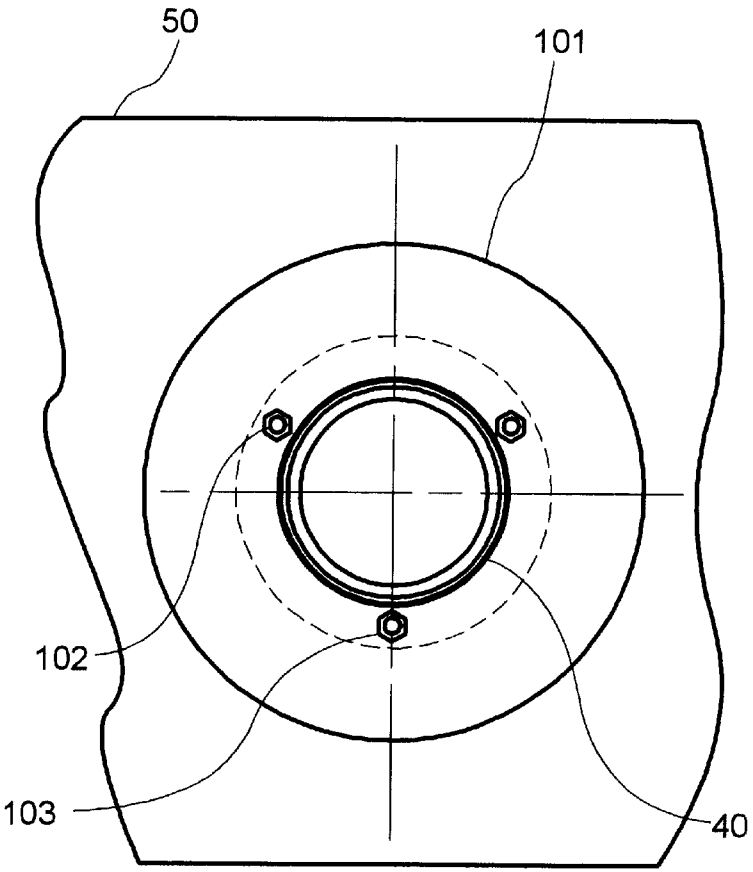
FIG. 14C schematically illustrates an end view of the jackscrew plate, jackscrews and jackscrew nuts of FIG. 14B.
Figure 14B:
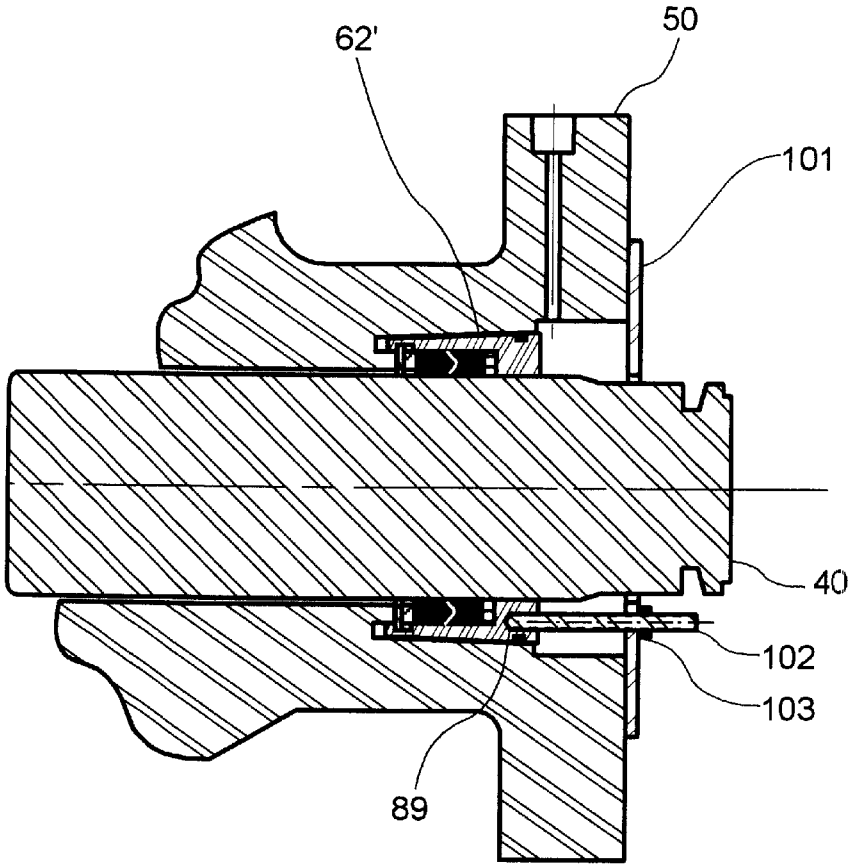
FIG. 14B schematically illustrates a plunger pump housing similar to that in FIG. 14A but wherein the separable gland nut has been replaced by jackscrews, jackscrew nuts and a jackscrew plate to facilitate removal of a tapered packing cartridge packing assembly.

Thus, it may sometimes be necessary to extract housing 62' from pump housing 50 without relying on simultaneous withdrawal of plunger 40. To accomplish extraction of housing 62' under this condition, three or more threaded jackscrew rods (or bolts) 102 may be screwed into three or more corresponding threaded bores 89 spaced uniformly around housing 62' in locations analogous to that shown in FIG. 14B. Next, a jackscrew plate 101 is positioned over (because it is larger than) the area of plunger pump housing 50 into which gland nut 32 is threaded (see, for example, FIGS. 14B and 14C). Plate 101 has a central hole that fits easily over plunger 40, with three or more surrounding holes corresponding to threaded jackscrew rods 102 (seen in the partial end view of FIG. 14C). Following such positioning of plate 101 over plunger 40 and threaded jackscrew rods 102, correspondingly threaded nuts 103 are screwed on each jackscrew rod, allowing housing 62' to be smoothly withdrawn toward plate 101 over plunger 40 as nuts 103 are incrementally tightened on rods 102. After cartridge packing housing 62' is thus withdrawn, plunger 40 will then be removable as shown in FIG. 13.

Figure 15:
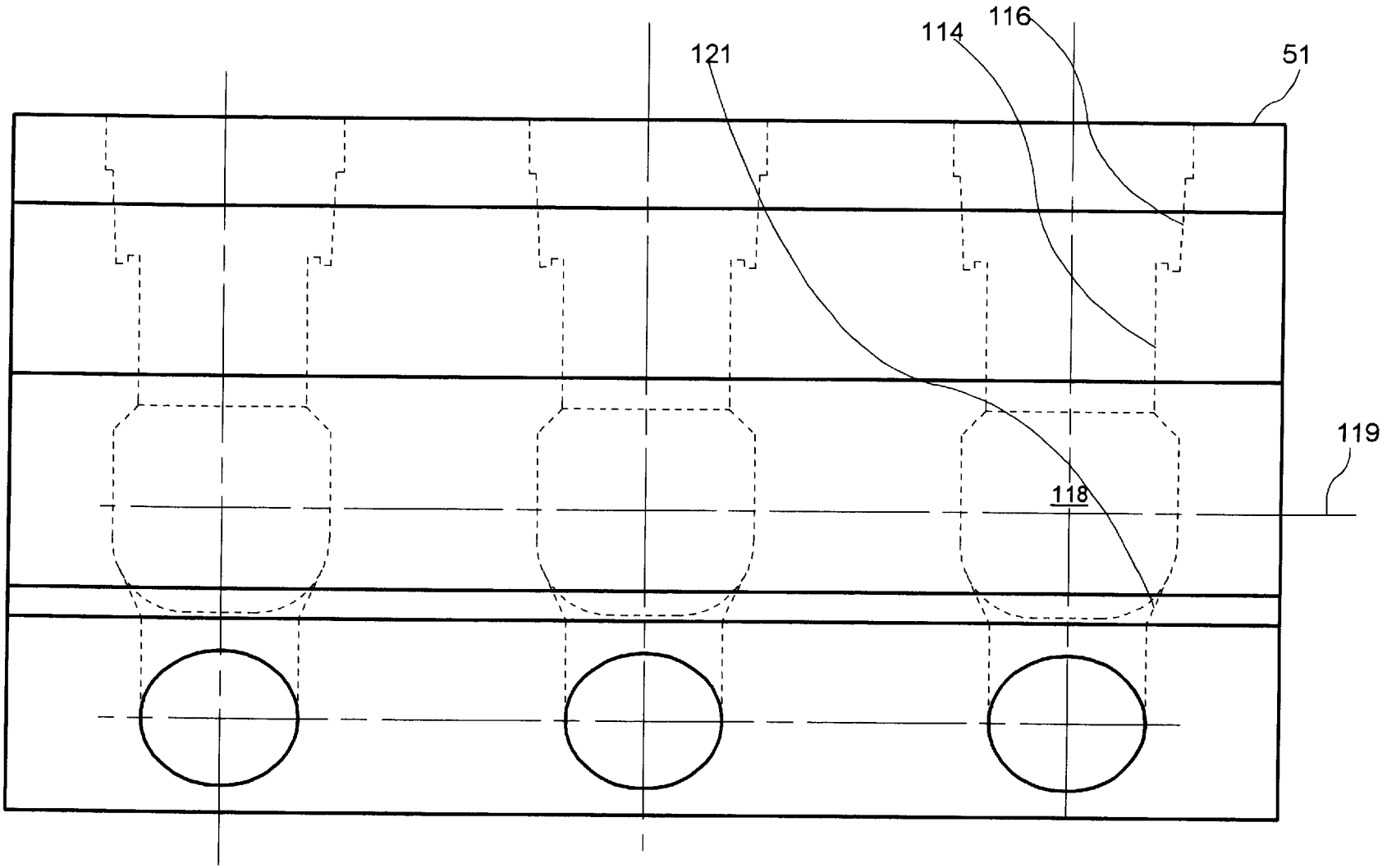
FIG. 15 schematically illustrates a top view of a 3-section Y-block plunger pump housing of the present invention.

FIG. 15 schematically illustrates a top view of plunger pump housing 51 of the present invention, housing 51 being analogous to housing 50 except that housing 51 is capable of accommodating three plungers. Discharge bores 112 are directly visible, and phantom (dotted) lines show the internal elongated bores 118.

What is claimed is:

1. A Y-block plunger pump housing comprising:

a suction valve bore having a substantially circular cross-section and a first centerline;

a discharge valve bore intersecting said suction valve bore, said discharge valve bore having a substantially circular cross-section and a second centerline, said first centerline being coplanar with and intersecting said second centerline, said first and second centerlines subtending a first angle; and a cylinder bore intersecting said suction valve bore and said discharge valve bore, said cylinder bore having a proximal packing area and a distal transition area, said packing area having a substantially circular cross-section and a third centerline, said third centerline being coplanar with and intersecting said first and second centerlines to allow substantially unimpeded fluid flow from said suction bore to said discharge bore under the influence of reciprocating plunger movement in said cylinder bore, said second and third centerlines subtending a second angle, and said first and third centerlines subtending a third angle;

wherein said cylinder bore transition area has a distal elongated cross-section substantially perpendicular to said third centerline and with a long axis substantially perpendicular to said plane of said first and second centerlines.

2. The pump housing of claim 1 wherein said first, second and third angles are each at least 90 degrees.

3. The pump housing of claim 1 wherein said distal elongated transition area cross-section is elliptical.

4. The pump housing of claim 1 wherein said distal elongated transition area cross-section is oblong.

5. The pump housing of claim 1 wherein said cylinder bore transition area has a proximal substantially circular cross-section perpendicular to said third centerline, said transition area cross-section changing smoothly from substantially circular to elongated from proximal to distal.

6. A tapered cartridge packing assembly comprising a packing cartridge housing having, a distal end, a proximal end, a longitudinal axis, a length between said distal and proximal ends, a substantially right cylindrical inner surface having a first diameter, a substantially coaxial right cylindrical outer surface extending distally from said proximal end for a portion of said cartridge housing length, and a conically tapered substantially coaxial outer surface extending distally from said distal extent of said right cylindrical outer surface to said cartridge housing distal end, said tapered outer surface tapering distally from said right cylindrical outer surface toward said longituidinal axis, said inner surface having a substantially coaxial cylindrical recess having a second diameter greater than said first diameter and extending from said distal end proximally to an internal stop;

a substantially coaxial packing ring within said cylindrical recess, said packing ring having an inner diameter substantially equal to said first diameter and an outer diameter substantially equal to said second diameter; and a substantially coaxial bearing ring within said cylindrical recess, said bearing ring having an inner diameter slightly less than said first diameter and an outer diameter about equal to said second diameter, said bearing ring being located within said cylindrical recess between said packing ring said internal stop.

7. The tapered cartridge packing assembly of claim 6 additionally comprising a substantially coaxial anti-extrusion ring within said cylindrical recess, said anti-extrusion ring having an inner diameter slightly less than said first diameter and an outer diameter about equal to said second diameter, said anti-extrusion ring being located in said cylindrical recess between said packing ring and said bearing ring.

8. The tapered cartridge packing assembly of claim 6 additionally comprising a substantially coaxial packing compression ring at least partially within said cylindrical recess, said packing compression ring having an inner diameter slightly greater than said first diameter, an outer diameter slightly less than said second diameter, said packing compression ring being located distal to said packing ring.

9. A tapered cartridge packing assembly comprising a packing cartridge housing having, a distal end, a proximal end, a longitudinal axis, a housing length between said distal and proximal ends, a substantially right cylindrical inner surface having a first diameter, and a conically tapered substantially coaxial outer surface extending distally from said proximal end to said distal end, said tapered outer surface tapering distally toward said longituidinal axis, said inner surface having a substantially coaxial cylindrical recess having a second diameter greater than said first diameter and extending from said distal end proximally to an internal stop;

a substantially coaxial packing ring within said cylindrical recess, said packing ring having an inner diameter substantially equal to said first diameter and an outer diameter substantially equal to said second diameter; and a substantially coaxial bearing ring within said cylindrical recess, said bearing ring having an inner diameter slightly less than said first diameter and an outer diameter about equal to said second diameter, said bearing ring being located within said cylindrical recess between said packing ring said internal stop.

10. The tapered cartridge packing assembly of claim 9 additionally comprising a substantially coaxial anti-extrusion ring within said cylindrical recess, said anti-extrusion ring having an inner diameter slightly less than said first diameter and an outer diameter about equal to said second diameter, said anti-extrusion ring being located in said cylindrical recess between said packing ring and said bearing ring.

11. The tapered cartridge packing assembly of claim 9 additionally comprising a substantially coaxial packing compression ring at least partially within said cylindrical recess, said packing compression ring having an inner diameter slightly greater than said first diameter, an outer diameter slightly less than said second diameter, said packing compression ring being located distal to said packing ring.

12. A Y-block plunger pump housing comprising:

a suction valve bore having a substantially circular cross-section and a first centerline;

a discharge valve bore intersecting said suction valve bore, said discharge valve bore having a substantially circular cross-section and a second centerline, said first centerline being coplanar with and intersecting said second centerline, said first and second centerlines subtending a first angle; and a cylinder bore intersecting said suction valve bore and said discharge valve bore centrally, said cylinder bore having a proximal packing area and a distal transition area, said proximal packing area having a substantially circular cross-section and a third centerline, said third centerline being coplanar with and intersecting said first and second centerlines to allow substantially unimpeded fluid flow from said suction bore to said discharge bore under the influence of reciprocating plunger movement in said cylinder bore, said second and third centerlines subtending a second angle, and said first and third centerlines subtending a third angle;

wherein said cylinder bore distal transition area has a distal elongated cross-section substantially perpendicular to said third centerline and with a long axis substantially perpendicular to said plane of said first and second centerlines and;

wherein said suction bore has an elongated cross-section adjacent to said cylinder bore distal elongated cross-section, said suction bore elongated cross-section being substantially perpendicular to said first centerline and with a long axis substantially perpendicular to said plane of said first and second centerlines.

13. The pump housing of claim 12 wherein said first, second and third angles are each at least 90 degrees.

14. The pump housing of claim 12 wherein said suction bore elongated cross-section is elliptical.

15. The pump housing of claim 12 wherein said suction bore elongated cross-section is oblong.

16. The pump housing of claim 12 wherein said cylinder bore transition area has a proximal substantially circular cross-section perpendicular to said third centerline, said transition area cross-section changing smoothly from substantially circular to elongated from proximal to distal.

17. A Y-block plunger pump, the pump comprising the pump housing of claim 12 and additionally comprising a suction valve retained in said suction valve bore, a discharge valve retained in said discharge valve bore, a plunger in said cylinder bore, and a tapered cartridge packing assembly in said proximal packing area of said cylinder bore.

18. The Y-block plunger pump of claim 17, wherein said suction valve is retained in said suction valve bore by a valve spring and a spoked suction valve spring retainer ring.

19. The Y-block plunger pump of claim 18, wherein said suction valve is a top stem guided valve.

20. The Y-block plunger pump housing of claim 17, wherein said suction valve bore comprises an internal retainer ledge and no circumferential threads.

21. A tapered cartridge packing assembly comprising a packing cartridge housing having, a distal end, a proximal end, a longitudinal axis, a housing length between said distal and proximal ends, a substantially right cylindrical inner surface having a first diameter, and a conically tapered substantially coaxial outer surface extending distally from said proximal end to said distal end, said tapered outer surface tapering distally toward said longituidinal axis, said inner surface having a substantially coaxial cylindrical recess having a second diameter greater than said first diameter and extending from said distal end proximally to an internal stop;

a substantially coaxial packing ring within said cylindrical recess, said packing ring having an inner diameter substantially equal to said first diameter and an outer diameter substantially equal to said second diameter; and wherein said tapered cartridge packing housing comprises bearing alloy.

22. The tapered cartridge packing assembly of claim 21 additionally comprising a substantially coaxial anti-extrusion ring within said cylindrical recess, said anti-extrusion ring having an inner diameter slightly less than said first diameter and an outer diameter about equal to said second diameter, said anti-extrusion ring being located between said packing ring and said internal stop.

23. The tapered cartridge packing assembly of claim 21 additionally comprising a substantially coaxial packing compression ring at least partially within said cylindrical recess, said packing compression ring having an inner diameter slightly greater than said first diameter, an outer diameter slightly less than said second diameter, said packing compression ring being located distal to said packing ring.

24. A tapered cartridge packing assembly comprising a packing cartridge housing having, a distal end, a proximal end, a longitudinal axis, a length between said distal and proximal ends, a substantially right cylindrical inner surface having a first diameter, a substantially coaxial right cylindrical outer surface extending distally from said proximal end for a portion of said cartridge housing length, and a conically tapered substantially coaxial outer surface extending distally from said distal extent of said right cylindrical outer surface to said cartridge housing distal end, said tapered outer surface tapering distally from said right cylindrical outer surface toward said longituidinal axis, said inner surface having a substantially coaxial cylindrical recess having a second diameter greater than said first diameter and extending from said distal end proximally to an internal stop;

a substantially coaxial packing ring within said cylindrical recess, said packing ring having an inner diameter substantially equal to said first diameter and an outer diameter substantially equal to said second diameter; and wherein said tapered cartridge packing housing comprises bearing alloy.

25. The tapered cartridge packing assembly of claim 24 additionally comprising a substantially coaxial anti-extrusion ring within said cylindrical recess, said anti-extrusion ring having an inner diameter slightly less than said first diameter and an outer diameter about equal to said second diameter, said anti-extrusion ring being located between said packing ring and said internal stop.

26. The tapered cartridge packing assembly of claim 24 additionally comprising a substantially coaxial packing compression ring at least partially within said cylindrical recess, said packing compression ring having an inner diameter slightly greater than said first diameter, an outer diameter slightly less than said second diameter, said packing compression ring being located distal to said packing ring.

* * * * *